US007398045B2

(12) United States Patent
Uehara et al.

(10) Patent No.: US 7,398,045 B2
(45) Date of Patent: Jul. 8, 2008

(54) FIXING UNIT AND IMAGE FORMING APPARATUS

(75) Inventors: Yasuhiro Uehara, Kanagawa (JP); Yasushi Kawahata, Kanagawa (JP); Daisuke Yoshino, Kanagawa (JP); Chikara Ando, Kanagawa (JP); Motofumi Baba, Kanagawa (JP); Yuka Nakayama, Kanagawa (JP); Toshiyuki Miyata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 166 days.

(21) Appl. No.: 11/398,660

(22) Filed: Apr. 6, 2006

(65) Prior Publication Data

US 2007/0048042 A1 Mar. 1, 2007

(30) Foreign Application Priority Data

Aug. 23, 2005 (JP) ..... P2005-241172
Aug. 29, 2005 (JP) ..... P2005-248352

(51) Int. Cl.
*G03G 15/20* (2006.01)

(52) U.S. Cl. ..... 399/329; 399/323

(58) Field of Classification Search ..... 399/67, 399/68, 320, 322, 323, 328, 329
See application file for complete search history.

(56) References Cited

FOREIGN PATENT DOCUMENTS

| | | |
|---|---|---|
| JP | 03-133871 | 6/1991 |
| JP | 2003-5566 | 1/2003 |

*Primary Examiner*—Hoang Ngo
(74) *Attorney, Agent, or Firm*—Morgan, Lewis & Bockius LLP

(57) ABSTRACT

A fixing unit for fixing a toner image on a recording material includes: a rotatable fixing roll; a fixing belt stretched on the fixing roll; at least one tension roll stretching the fixing belt with the fixing roll; a pressurization member disposed to give a pressure to the fixing roll; and a stripping member disposed to press the outer surface of the fixing belt onto the pressurization member in a vicinity of a downstream side of a first contact portion between the fixing roll and the pressurization member.

48 Claims, 16 Drawing Sheets

FIG. 6

| DISTANCE FROM FIXING ROLL OF STRIPPING PAD (mm) | 0.2 | 0.5 | 0.7 | 1.0 | 1.5 | 2.0 | 3.0 |
|---|---|---|---|---|---|---|---|
| GENERATION OF IMAGE DEFECTS | ○ | ○ | ○ | × | × | × | × |

○ : IMAGE DEFECTS ARE NOT GENERATED
× : IMAGE STAINS ARE GENERATED

FIG. 7

| PRESSING FORCE OF STRIPPING PAD (N/cm2) | 2 | 5 | 7 | 10 | 15 | 20 |
|---|---|---|---|---|---|---|
| GENERATION OF IMAGE DEFECTS | × | × | ○ | ○ | ○ | ○ |

○ : IMAGE DEFECTS ARE NOT GENERATED
× : IMAGE STAINS ARE GENERATED

FIG. 15

| PROCESS SPEED | 350mm/s | | 440mm/s | |
|---|---|---|---|---|
| TEST ITEM | SHEET STRIPPING STATE | DEVIATION OF IMAGE | SHEET STRIPPING STATE | DEVIATION OF IMAGE |
| EMBODIMENT | GOOD | NONE | GOOD | NONE |
| COMPARATIVE EXAMPLE | STRIPPING DEFECT | NONE | STRIPPING DEFECT | NONE |

FIXING UNIT AND IMAGE FORMING APPARATUS

CROSS-REFERENCE TO RELATED APPLICATIONS

This application is based on and claims the benefit of priority from the prior Japanese Patent Applications No. 2005-241172, filed on Aug. 23, 2005 and 2005-248352, filed on Aug. 29, 2005: the entire contents of which are incorporated herein by reference.

BACKGROUND

1. Technical Field

The present invention relates to a fixing unit used in an image forming apparatus for an electrophotographic manner, and more particularly to a fixing unit having a rotatable belt member.

2. Related Art

In image forming apparatuses such as copiers and printers employing an electrophotographic manner, an image is formed as follows. First, for example, the surface of a photosensitive member (photosensitive drum) formed in a drum shape is uniformly charged by a charging unit. The charged photosensitive drum is scanned and exposed by light controlled in accordance with image information and an electrostatic latent image is formed the surface thereof. Subsequently, the electrostatic latent image on the photosensitive drum is made into a visible image (toner image) by a developing unit and the toner image is transported to a transfer unit, where the toner image is electrostatically transferred onto a sheet of recording paper. The toner image transferred onto the sheet of recording paper is subjected to a fixing process, thereby completing the toner image.

The fixing unit used in such an image forming apparatus has, for example, a configuration that a fixing roll in which a heat-resistant elastic layer and a detachment layer are stacked on the surface of a cylinder-shaped core bar having a heating source (heater) disposed therein and a pressurization roll in which a heat-resistant elastic layer and a detachment layer made of a heat-resistant resin film or a heat-resistant rubber film are stacked on a core bar come in close contact with each other. A toner image is fixed onto a recording sheet by allowing the recording sheet having supported a non-fixed toner image to pass through a contact area (nip portion) between the fixing roll and the pressurization roll and performing a heating and pressurizing process to the non-fixed toner image. Such a fixing unit is referred to as a two-roll type fixing unit and has been widely used in general.

In recent years, increase in productivity and color has been rapidly advanced in image forming apparatuses and apparatuses having a double-sided printing mechanism have been spread more and more. Accordingly, a fixing unit which can cope with increase in process speed has been required more and more.

However, when the increase in process speed is accomplished by the use of the two-roll type fixing unit, it is difficult to sufficiently perform a fixing process to plural recording sheets continuously supplied for a short time. That is, in the two-roll type fixing unit, since the core bar constituting the fixing roll or the elastic layer made of a silicon rubber coated on the core bar serve as heat-resistant bodies, it is difficult to instantaneously and sufficiently supply a heat amount, which corresponds to the heat amount released from the surface of the fixing roll to the recording sheets, from a heater disposed in the fixing roll.

Therefore, a surface temperature of the fixing roll gradually decreases during the continuous feed of sheets to gradually deteriorate the fixing performance. In addition, at the time of initiating the image forming apparatus, a so-called "temperature dropping phenomenon" that the surface temperature of the fixing roll temporarily droops can occur easily. Specifically, when thick sheets of paper having a great heat capacity are used as the recording sheets, the heat amount released from the surface of the fixing roll increases. Accordingly, the deterioration in fixing performance or the droop in temperature increases, thereby easily causing deterioration in image quality due to the fixing failure.

Accordingly, a technology for solving the above-mentioned problems in a case that the two-roll type fixing unit is used and embodying a fixing unit coping with the increase in speed of an image forming apparatus, there is known a technology relating to a fixing unit in which a heating member is constructed to suspend a film-shaped belt member (fixing belt) on plural tension rolls. That is, there is known a technology of fixing a toner image by previously heating the fixing belt with a heater disposed inside the tension rolls before the fixing belt enters the nip portion and heating the recording sheet and the toner image through the heated fixing belt in the nip portion.

In the fixing unit employing such a belt member, since the heat capacity of the belt member is small, it is easy to recover the belt member to a predetermined fixing temperature for a short time even when heat is released to the recording sheet during the fixing process. Therefore, such a configuration of the fixing unit is very suitable for accomplishing the increase in speed of the image forming apparatus.

In the fixing unit employing the fixing belt, a toner image is supported on the surface of a recording sheet. Accordingly, when the toner image is fused by the heat from the fixing belt, the toner image serves as adhesive and an adhesive force acts between the recording sheet and the fixing belt. Therefore, it is necessary to provide a mechanism for stripping the recording sheet from the surface of the fixing belt. Specifically, when the increase in speed of the image forming apparatus is required and the detachment failure occurs in the fixing unit to cause a jam of paper, the number of successive recording sheets to be damaged increase due to the influence of the jam of paper. Accordingly, it is necessary to stably detach the recording sheet having passed through the nip portion at a high speed from the fixing belt.

As the mechanism for stripping the recording sheet from the surface of the fixing belt, a configuration that a stripping claw is disposed at the downstream side of the nip portion to abut the fixing belt is employed. Further, in a configuration that the fixing belt stretched on the fixing roll and the heating roll and the pressurization roll are disposed in close contact with each other, a fixation member for setting the curvature of the fixing belt great at an exit portion of the nip portion is provided at the inside of the fixing belt and at the position corresponding to the exit portion (the most downstream portion) so as to detach the recording sheet by the use of variation in curvature of the fixing belt.

However, in a fixing unit using a fixing belt, when a stripping claw is used as the mechanism for stripping the recording sheet from a surface of the fixing belt, it is necessary to dispose the stripping claw in contact with the fixing belt so as to stably detach a recording sheet from the fixing belt. As a result, the surface of the fixing belt can be easily worn out by the stripping claw. When a worn mark is generated on the surface of the fixing belt, a fixing stain corresponding to the worn mark can be generated on a fixed image, thereby deteriorating image quality. In addition, toners offset onto the worn mark can be gradually deposited, thereby generating contaminations on the fixed image. Furthermore, when the wear of the fixing belt is advanced, the thin fixing belt may be finally destroyed, thereby damaging the function of the fixing unit.

When a fixation member for making the curvature of the fixing belt great is disposed at an exit of a nip portion as a mechanism for stripping the recording sheet from the surface of the fixing belt, the fixing belt comes in close contact with a pressurization roll by only a tension of the fixing belt at an intermediate nip region between an entrance of the nip portion where the fixing roll and the pressurization roll come in close contact with each other and the exit in which the fixation member is disposed. Accordingly, the nip pressure at the intermediate nip region is relatively low. When the recording sheet or the toner is heated in a low nip-pressure region, moisture in the recording sheet can be vaporized into steam or air in the toner can be thermally expanded, thereby generating air gaps (bubbles) between the fixing belt and the pressurization roll. When such air gaps are generated, a non-fixed toner can be easily disturbed because the air gaps are floated in a state that the toner on the recording sheet positioned in the nip portion is not completely fixed. As a result, image defects such as stains may be easily generated in a fixed image.

In the fixing unit using the fixing belt, when the stripping claw is used as the mechanism for stripping the recording sheet from the surface of the fixing belt, it is necessary to dispose the stripping claw in contact with the fixing belt so as to stably detach the recording sheet from the fixing belt. As a result, when the stripping claw is used, the surface of the fixing belt can be easily worn out by the stripping claw. When a worn mark is generated on the surface of the fixing belt, a fixing stain corresponding to the worn mark on the surface of the fixing belt can be generated on the fixed image, thereby deteriorating image quality. In addition, toners offset onto the worn mark can be gradually deposited, thereby generating contaminations on the fixed image. Furthermore, when the wear of the surface of the fixing belt is advanced, the thin fixing belt may be finally destroyed, thereby damaging the function of the fixing unit.

When the fixation member for making the curvature of the fixing belt great is disposed at the exit of the nip portion as the mechanism for stripping the recording sheet from the surface of the fixing belt, the fixing belt comes in close contact with the pressurization roll by only the tension of the fixing belt at an intermediate nip region between an entrance of the nip portion where the fixing roll and the pressurization roll comes in close contact with each other and the exit in which the fixation member is disposed. Accordingly, the nip pressure at the intermediate nip region is relatively low. When the recording sheet or the toner is heated in the low nip-pressure region, moisture in the recording sheet can be vaporized into steam or air in the toner can be thermally expanded, thereby generating air gaps (bubbles) between the fixing belt and the pressurization roll. When such air gaps are generated, the non-fixed toner can be easily disturbed because the bubbles are floated in the state that the toner on the recording sheet positioned in the nip portion is not completely fixed. As a result, image defects such as stains may be easily generated in a fixed image, thereby causing the deterioration in image quality.

SUMMARY OF THE INVENTION

According to an aspect of the invention, a fixing unit for fixing a toner image on a recording material includes: a rotatable fixing roll; a fixing belt stretched on the fixing roll; a tension roll for stretching the fixing belt; a pressurization member disposed to give a pressure to the fixing roll; and a stripping member disposed to press the outer surface of the fixing belt onto the pressurization member in a vicinity of a downstream side of a contact portion between the fixing roll and the pressurization member.

BRIEF DESCRIPTION OF THE DRAWINGS

Exemplary embodiment(s) of the present invention will be described in detail based on the following figures, wherein:

FIG. 6 is a diagram illustrating a relation between a distance between the stripping pad and the fixing roll and an image defect on a fixed image;

FIG. 7 is a diagram illustrating a relation between a pressurizing force of the stripping pad and the image defect on the fixed image;

FIG. 15 is a diagram illustrating a test result of a sheet detachment performance and an image quality (existence of image deviation)

DETAILED DESCRIPTION

Hereinafter, exemplary embodiments of the present invention will be described in detail with reference to the accompanying drawings.

First Exemplary Embodiment

Figure 1:
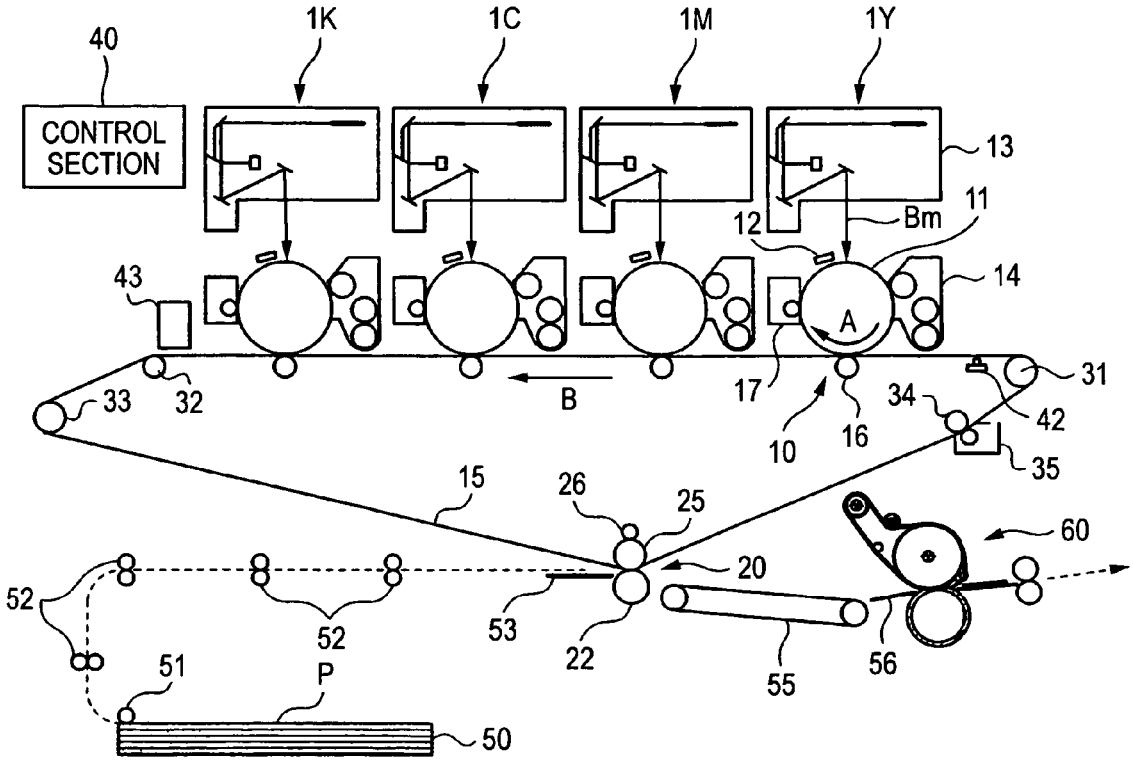
FIG. 1 is a diagram schematically illustrating a configuration of an image forming apparatus according to a first exemplary embodiment.

FIG. 1 is a diagram schematically illustrating an image forming apparatus to which a first exemplary embodiment of the invention is applied. The image forming apparatus illustrated in FIG. 1 is an intermediate transfer type image forming apparatus which is generally referred to as tandem type and includes plural image forming units 1Y, 1M, 1C, and 1K for forming toner images of corresponding color components by the use of an electrophotographic manner, a primary transfer unit 10 for sequentially transferring (primarily transferring) the toner images of corresponding color components formed by the image forming units 1Y, 1M, 1C, and 1K onto an intermediate transfer belt 15, a secondary transfer unit 20 for transferring (secondarily transferring) the overlapped toner images transferred onto the intermediate transfer belt 15 onto a sheet P as a recording material (recording sheet) P in a bundle, and a fixing unit 60 for fixing the secondarily transferred images onto the sheet P. The image forming apparatus further includes a control unit 40 for controlling the respective units.

In the first exemplary embodiment, in the respective image forming units 1Y, 1M, 1C, and 1K, electrophotographic devices such as a charger 12 for charging a photosensitive drum 11, a laser exposing device 13 (of which exposing beams are denoted by reference numeral Bm in the figure) for forming an electrostatic latent image on the photosensitive drum 11, a developing device 14 for receiving a corresponding color toner and making the electrostatic latent image on the photosensitive drum 11 into a visible image with the toner, a primary transfer roll 16 for transferring the color toner image formed on the photosensitive drum 11 onto the intermediate transfer belt 15 in the primary transfer unit 10, and a drum cleaner 17 for removing the remaining toner from the photosensitive drum 11 are sequentially disposed around the photosensitive drum 11 rotating in the arrow direction A. The image forming units 1Y, 1M, 1C, and 1K are disposed in a substantially linear shape in the order of yellow Y, magenta M, cyan C, and black K from the upstream side of the intermediate transfer belt 15.

The intermediate transfer belt 15 as an intermediate transfer member is formed of a film-shaped endless belt in which a proper amount of charging prevention agent such as carbon black is contained in resin such as polyimide and polyamide. The volume resistivity thereof is in the range of $10^6$ to $10^{14}$ Ωcm and the thickness thereof is about 0.1 mm. The intermediate transfer belt 15 is circulated by various rolls at a predetermined speed in the direction B shown in FIG. 1. The various rolls include a driving roll 31 which is driven with a motor (not shown) having an excellent constant rate property so as to circulate the intermediate transfer belt 15, a support roll 32 for supporting the intermediate transfer belt 15 extending linearly in the arrangement direction of the photosensitive drums 11, a tension roll 33 giving a constant tension to the intermediate transfer belt 15 and also serving as a correction roll for preventing the meandering of the intermediate transfer belt 15, a backup roll 25 disposed in the secondary transfer unit 20, and a cleaning backup roll 34 disposed in a cleaning unit for removing the remaining toner on the intermediate transfer belt 15.

The primary transfer unit 10 includes a primary transfer roll 16 disposed to be facing the corresponding photosensitive drum 11 with the intermediate transfer belt 15 therebetween. The primary transfer roll 16 includes a shaft and a sponge layer as an elastic layer formed on the shaft. The shaft is a cylinder bar made of metal such as iron and SUS. The sponge layer is made of a blend rubber of NBR, SBR, and EPDM with which conductive agent such as carbon black is mixed and is a cylinder roll of a sponge shape having a volume resistivity of $10^7$ to $10^9$ Ωcm. The primary transfer roll 16 is disposed to come in close contact with the photosensitive drum 11 with the intermediate transfer belt 15 therebetween and the primary transfer roll is supplied with a voltage (primary transfer bias) having a polarity opposite to the charged polarity (minus polarity) of a toner. Accordingly, the toner images on the photosensitive drums 11 are sequentially electrostatically transferred to the intermediate transfer belt 15, thereby forming overlapped toner images on the intermediate transfer belt 15.

The second transfer unit 20 includes a secondary transfer roll 22 disposed on the surface of the intermediate transfer belt 15 carrying the toner images and a backup roll 25. The surface of the backup roll 25 is made of a blend rubber of EPDM and NBR in which carbon is dispersed and the inside thereof is made of an EPDM rubber. The surface resistivity is in the range of $10^7$ to $10^{10}$ Ω/□ and the hardness is about 70 degree (Aska-C). The backup roll 25 is disposed on the back surface of the intermediate transfer belt 15 to form a counter electrode of the secondary transfer roll 22 and to come in contact with a metal power supply roll 26 to which a secondary transfer bias is stably supplied.

On the other hand, the secondary transfer roll 22 includes a shaft and a sponge layer as an elastic layer formed on the shaft. The shaft is a cylinder bar made of metal such as iron and SUS. The sponge layer is made of a blend rubber of NBR, SBR, and EPDM with which conductive agent such as carbon black is mixed and is a cylinder roll of a sponge shape having a volume resistivity of $10^7$ to $10^9$ Ωcm. The secondary transfer roll 22 is disposed to come in close contact with the backup roll 25 with the intermediate transfer belt 15 therebetween. The secondary transfer roll 22 is grounded to form a second transfer bias between the backup roll 25 and the secondary transfer roll 22, thereby secondarily transferring the toner image on the sheet P fed to the secondary transfer unit 20.

At the downstream side from the secondary transfer unit 20 in the intermediate transfer belt 15, an intermediate transfer belt cleaner 35 for removing the remaining toner or paper particles on the intermediate transfer belt 15 after the secondary transfer and cleaning the surface of the intermediate transfer belt 15 is disposed detachably. On the other hand, at the upstream side from the yellow image forming unit 1Y, a reference sensor (home position sensor) 42 for generating reference signals for taking image forming times in the image forming units 1Y, 1M, 1C, and 1K is disposed. At the downstream side from the black image forming unit 1K, an image concentration sensor 43 for adjusting image quality is disposed. The reference sensor 42 recognizes a predetermined mark disposed on the back surface of the intermediate transfer belt 15 to generate the reference signals. The respective image forming units 1Y, 1M, 1C, and 1K start the formation of image in accordance with an instruction from the control unit 40 based on the recognition of the reference signals.

In the image forming apparatus according to the first exemplary embodiment, a sheet feeding system includes a sheet tray 50 for receiving sheets P, a pickup roll 51 for picking up and feeding the sheets P piled on the sheet tray 50 at a predetermined time, a feed roll 52 for feeding the sheets P from the pickup roll 51, a feed chute 53 for sending the sheets P fed by the feed roll 52 to the second transfer unit 20, a feed belt 55 for feeding the sheets P having been subjected to the secondary transfer operation in the secondary transfer roll 22 to the fixing unit 60, and a fixing entrance guide 56 for guiding the sheets P to the fixing unit 60.

Next, a basic image forming process of the image forming apparatus according to the first exemplary embodiment is described. In the image forming apparatus shown in FIG. 1, the image data output from an image readout device (IIT) not shown or a personal computer (PC) not shown are subjected to a predetermined image processing operation by an image processing system (IPS) not shown and then are subjected to image forming processes by the image forming units 1Y, 1M, 1C, and 1K. The IPS perform predetermined image processing operations such as shading correction, correction of positional deviation, conversion of brightness/color space, gamma correction, and various image edition of removal of frame, color edition, movement edition, and the like to input reflectivity data. The image data having been subjected to the image processing operation are converted into four-color gray scale data of Y, M, C, and K and then are output to a laser exposing device 13.

The laser exposing unit 13 irradiates exposing beams Bm emitted from, for example, a semiconductor laser to the photosensitive drums 11 of the image forming units 1Y, 1M, 1C, and 1K, in accordance with the input color gray scale data. In the photosensitive drums 11 of the image forming units 1Y, 1M, 1C, and 1K, the surface is charged by the charging unit 12 and is scanned and exposed by the laser exposing unit 13, thereby forming electrostatic latent images. The electrostatic latent images are developed by the developing units 14 of the image forming units 1Y, 1M, 1C, and 1K into color toner images of Y, M, C, and K, respectively.

The toner images formed on the photosensitive drums 11 of the image forming units 1Y, 1M, 1C, and 1K are transferred onto the intermediate transfer belt 15 in the primary transfer unit 10 in which the respective photosensitive drums 11 and the intermediate transfer belt 15 come in contact with each other. More specifically, in the primary transfer unit 10, a voltage (primary transfer bias) of a polarity (plus polarity) opposite to the charged polarity of the toner is applied to the base member of the intermediate transfer belt 15 from the primary transfer roll 16 and the toner images are sequentially superposed on the surface of the intermediate transfer belt 15. That is, the primary transfer process is performed.

After the toner images are sequentially primarily transferred to the surface of the intermediate transfer belt 15, the intermediate transfer belt 15 is moved and thus the toner image is carried to the secondary transfer unit 20. When the toner image is carried to the secondary transfer unit 20, the pickup roll 51 rotates in accordance with the timing that the toner image is transferred to the secondary transfer unit 20 and a sheet P having a predetermined size is supplied from the sheet tray 50, in the sheet feeding system. The sheet P supplied by the pickup roll 51 is fed by the feed roll 52 and reaches the secondary transfer unit 20 through the feed chute 53. Before the sheet reaches the secondary transfer unit 20, the sheet P is temporarily stopped and the sheet P and the toner image are positioned with respect to each other by rotating a resist roll (not shown) at the movement timing of the intermediate transfer belt 15 carrying the toner image.

In the secondary transfer unit 20, the secondary transfer roll 22 is pressed on the backup roll 25 with the intermediate transfer belt 15 therebetween. At this time, the sheet P fed in time is inserted between the intermediate transfer belt 15 and the secondary transfer roll 22. When a voltage (secondary transfer bias) having a polarity (minus polarity) equal to the charged polarity of the toner is applied from the power supply roll 26, a transfer electric field is formed between the secondary transfer roll 22 and the backup roll 25. The non-fixed toner image carried on the intermediate transfer belt 15 is elastically transferred onto the sheet P at a time in the secondary transfer unit 20 in which the sheet is pressed by the secondary transfer roll 22 and the backup roll 25.

Thereafter, the sheet P onto which the toner image has been electrostatically transferred is fed through the secondary transfer roll 22 in the state that the sheet is stripped from the intermediate transfer belt 15 and is fed to the feed belt 55 disposed at the downstream side in the sheet feed direction from the secondary transfer roll 22. The feed belt 55 feeds the sheet P to the fixing unit 60 at the optimum feed speed corresponding to the feed speed of the fixing unit 60. The non-fixed toner image on the sheet P fed to the fixing unit 60 is fixed onto the sheet P through a fixing process using heat and pressure by the fixing unit 60. The sheet P on which the fixed image has been formed is fed to a discharged sheet tray (not shown) disposed in a discharge unit of the image forming apparatus.

On the other hand, the residual toner remaining on the intermediate transfer belt 15 after the transfer of the toner image to the sheet P is completed is carried with the circulation of the intermediate transfer belt 15 and is removed from the intermediate transfer belt 15 by the cleaning backup roll 34 and the intermediate transfer belt cleaner 35.

Next, the fixing unit 60 used in the image forming apparatus according to the first exemplary embodiment will be described.

Figure 2:
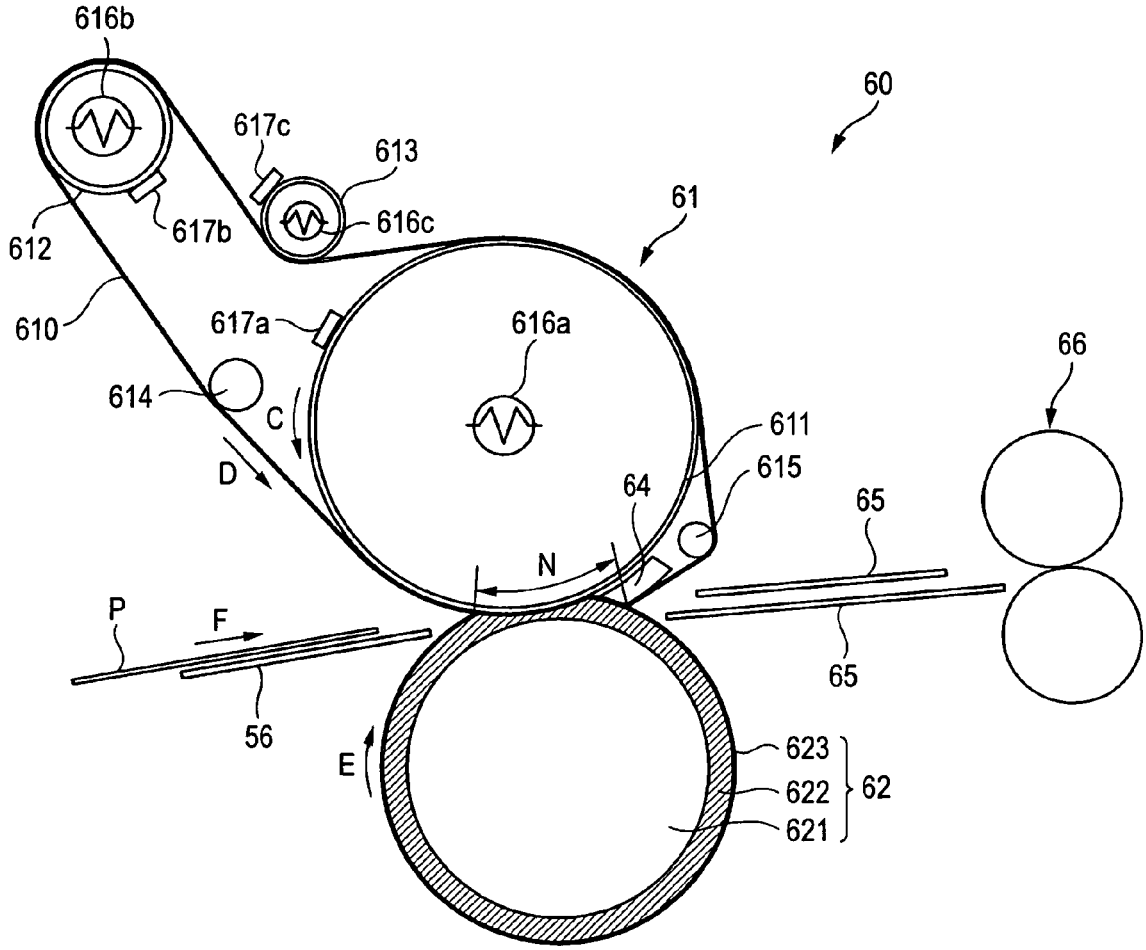
FIG. 2 is a side cross-sectional view schematically illustrating a configuration of a fixing unit according to the first exemplary embodiment.

FIG. 2 is a side cross-sectional view schematically illustrating a configuration of the fixing unit 60 according to the first exemplary embodiment. The fixing unit 60 includes a fixing belt module 61 as an example of a heating member and a pressurization roll 62 as an example of a pressurization member disposed to come in close contact with the fixing belt module 61.

The fixing belt module 61 includes a fixing belt 610 as an example of a belt member, a fixing roll 611 for stretching and circulating the fixing belt 610, a tension roll 612 for stretching the fixing belt 610 from the inside, a tension roll 613 for stretching the fixing belt from the outside, a posture correction roll 614 for correcting a posture of the fixing belt 610 between the fixing roll 611 and the tension roll 612, a stripping pad 64 as an example of a stripping member disposed at a downstream region in a nip portion N where the fixing belt module 61 and the pressurization roll 62 come in close contact with each other, that is, at a position in the vicinity of the fixing roll 611, and a tension roll 615 for stretching the fixing belt 610 at the downstream side of the nip portion P.

The fixing belt 610 is a flexible endless belt having a major length of 314 mm and a width of 340 mm and has a multilayered structure including a base layer made of polyimide resin with a thickness of 80 μm, an elastic layer made of silicon rubber with a thickness of 200 μm which is formed on the surface (outer circumferential surface) of the base layer, and a detachment layer formed of a copolymer resin tube of tetrafluoroethylene—perfluoroalkylvinylether (PFA tube) with a thickness of 30 μm which is formed on the elastic layer. Here, the elastic layer serves to improve the image quality of color images. On the other hand, the material, thickness, hardness, and the like of the fixing belt 610 can be properly selected in accordance with apparatus design conditions such as purposes of use or conditions of use.

The fixing roll 611 is a cylinder-shaped roll made of aluminum with an outer diameter of 65 mm, a length of 360 mm, and a thickness of 10 mm. The fixing roll 611 rotates in the arrow C direction at a surface speed of 300 mm/s with the driving force from a driving motor not shown.

A halogen heater 616*a* with a rated power of 900 W as a heating source is disposed in the fixing roll 611 and the control unit 40 (see FIG. 1) of the image forming apparatus controls the surface temperature of the fixing roll 611 to 150° C. on the basis of measured values of a temperature sensor 617*a* disposed to come in contact with the surface of the fixing roll 611.

The tension roll 612 is a cylinder-shaped roll made of aluminum with an outer diameter of 30 mm, a length of 360 mm, and a thickness of 2 mm. A halogen heater 616*b* with a rated power of 1000 W as a heating source is disposed in the tension roll 612 and the temperature sensor 617*b* and the control unit 40 (see FIG. 1) controls the surface temperature of the tension roll 612 to 190° C. Accordingly, the tension roll 612 has the function of heating the fixing belt 610 in addition to the function of stretching the fixing belt 610.

A spring member (not shown) for pressing the fixing belt 610 to the outside is disposed at both ends of the tension roll 612 and the entire tension of the fixing belt 610 is set to 15 kgf. Here, in order to make uniform the tension of the fixing belt 610 in the width direction and suppress the axial displacement of the fixing belt 610 as much as possible, the tension roll 612 has a so-called crown shape in which the outer diameter is larger at the ends by 100 μm than at the center.

The tension roll 613 is a cylinder-shaped roll made of aluminum with an outer diameter of 25 mm, a thickness of 2 mm, and a length of 360 mm. The surface of the tension roll 613 is coated with PFA having a thickness of 20 μm to form a detachment layer. The detachment layer serves to prevent offset toners or paper particles from the outer circumferential surface of the fixing belt 610 from being deposited on the tension roll 613. Similarly to the tension roll 612, the tension roll 613 is formed in a crown shape that the outer diameter is greater at the center by 100 μm than at the ends. Both of the tension roll 612 and the tension roll 613 may be formed in a crown shape or one of the tension roll 612 and the tension roll 613 may be formed in a crown shape.

A halogen heater 616*c* with a rated power of 1000 W as a heating source is disposed in the tension roll 613 and the surface temperature thereof is controlled to 190° C. by the temperature sensor 617*c* and the control unit 40 (see FIG. 1). Therefore, the tension roll 613 has the function of heating the fixing belt 610 from the outer surface thereof in addition to the function of stretching the fixing belt 610. Accordingly, in the first exemplary embodiment, the fixing belt 610 is heated by the fixing roll 611, the tension roll 612, and the tension roll 613.

The posture correction roll 614 is a cylinder-shaped roll made of aluminum with an outer diameter 15 mm and a length of 360 mm. A belt edge position detecting mechanism (not shown) for detecting the edge position of the fixing belt 610 is disposed in the vicinity of the posture correction roll 614. The posture correction roll 614 is provided with an axial displacement mechanism for displacing the contact position in the axis direction of the fixing belt 610 in accordance with the detection result of the belt edge position detecting mechanism, so as to control the meandering (belt walk) of the fixing belt 610.

The stripping pad 64 is a block member having a circular arc-shaped section and being made of a rigid body such as SUS, metal, and resin. At a downstream position from a region (referred to as "roll nip portion": see FIG. 3) that the pressurization roll 62 is pressed to the fixing roll 611 with the fixing belt 610 therebetween, the stripping pad is disposed in the entire axial length of the fixing roll 611. The stripping pad 64 uniformly presses the pressurization roll 62 to the fixing belt 610 in a predetermined width range (for example, width of 2 mm in the traveling direction of the fixing belt 610) with a predetermined load (for example, average load of 10 kgf) to form a "stripping pad nip portion N2" (see FIG. 3) to be described later.

The tension roll 615 is a cylinder-shaped roll made of aluminum with an outer diameter 12 mm and a length of 360 mm. The tension roll 615 is disposed in the vicinity of the downstream side from the stripping pad 64 in the traveling direction of the fixing belt 610, so that the fixing belt 610 passing through the stripping pad 64 can circulate smoothly toward the fixing roll 611.

Next, the pressurization roll 62 includes a cylinder-shaped roll 621 made of aluminum with a diameter of 45 mm and a length of 360 mm as a base member and an elastic layer made of silicon rubber having a rubber hardness of 30 degree (JIS-A) with a thickness of 10 mm and a detachment layer 623 made of a PFA tube with a thickness of 100 μm, which are stacked sequentially from the base member. The pressurization roll 62 is pressed to the fixing belt module 61 and rotates in the arrow E direction with the rotation of the fixing roll 611 as the fixing roll 611 of the fixing belt module 61 rotates in the arrow C direction. The rotation speed is 300 mm/s, which is equal to the surface speed of the fixing roll 611.

Subsequently, the nip portion N in which the fixing belt module 61 and the pressurization roll 62 come in close contact with each other will be described.

Figure 3:
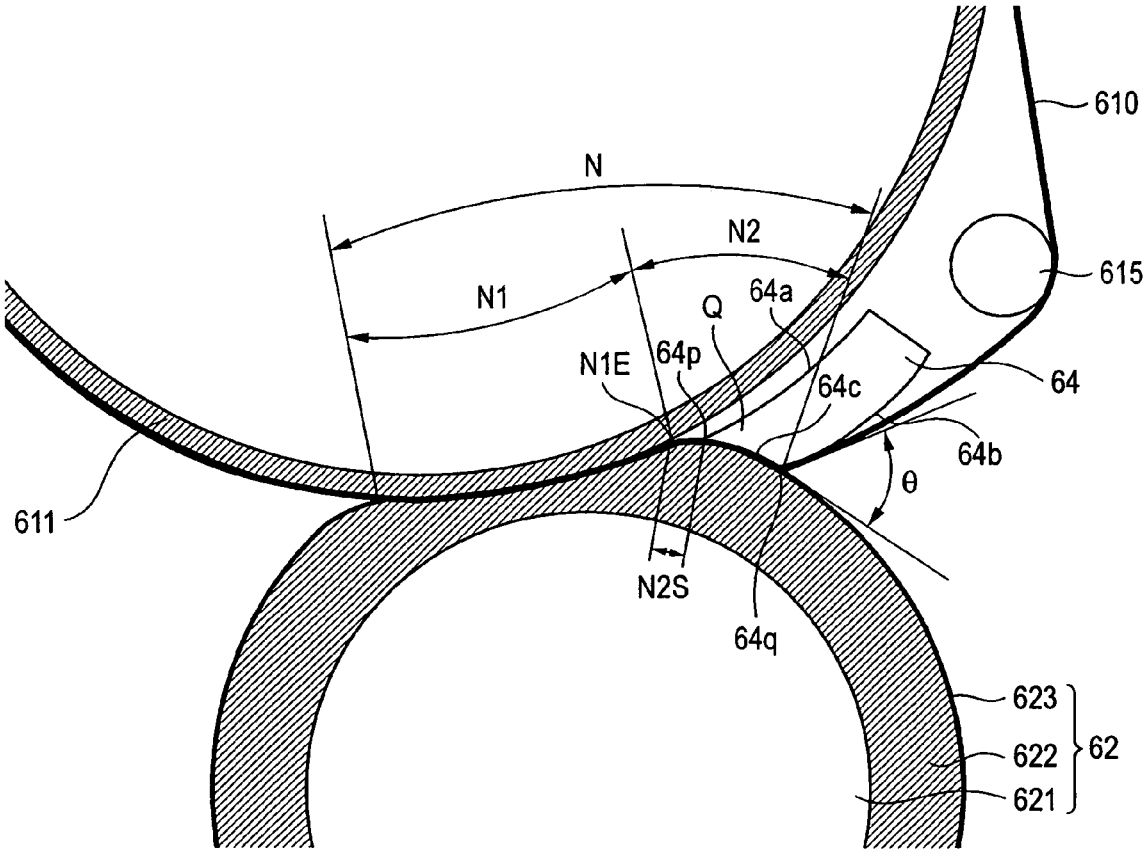
FIG. 3 is a cross-sectional view schematically illustrating the vicinity of a nip portion.

FIG. 3 is a diagram schematically illustrating the vicinity of the nip portion N. As shown in FIG. 3, a roll nip portion (first nip portion) N1 is formed in the nip portion N in which the fixing belt module 61 and the pressurization roll 62 come in close contact with each other, by disposing the pressurization roll 62 to come in close contact with the outer circumferential surface of the fixing belt 610 in a region (wrap region) in which the fixing belt 610 is wound around the fixing roll 61.

Here, in the fixing unit 60 according to the first exemplary embodiment, the fixing roll 611 is a hard roll made of aluminum and the pressurization roll 62 is a soft roll coated with the elastic layer 622. Accordingly, in the roll nip portion N1, since a recess is hardly generated in the fixing roll 611 but a recess is generated only on the surface of the pressurization roll 62 (recess amount of the pressurization roll 62>recess amount of the fixing roll 611), a nip region having a predetermined width in the traveling direction of the fixing belt 610 is formed.

In this way, in the fixing unit 60 according to the first exemplary embodiment, since the fixing roll 611 on which the fixing belt 610 is wrapped in the roll nip portion N1 is hardly deformed, the cylinder shape thereof is maintained. Accordingly, since the fixing belt 610 circulates along the circumferential surface of the fixing roll 611 and the circulation diameter does not vary, the fixing belt can pass through the roll nip portion N1 while maintaining the traveling speed. Therefore, when the fixing belt 610 passes through the roll nip portion N1, wrinkles or distortions are hardly generated in the fixing belt 610. As a result, the occurrence of image disturbance can be prevented in the fixed image, thereby stably providing a fixed image with good image quality. In the fixing unit 60 according to the first exemplary embodiment, the roll nip portion N1 has a width of 15 mm in the traveling direction of the fixing belt 610.

The stripping pad 64 is disposed in the vicinity of the downstream side from the roll nip portion N1 and the stripping pad 64 presses the fixing belt 610 to the surface of the pressurization roll 62. Accordingly, a stripping pad nip portion (second nip portion) N2 in which the fixing belt 610 is wound around the surface of the pressurization roll 62 is defined successively to the roll nip portion N1.

As shown in FIG. 3, the stripping pad 64 defining the stripping pad nip portion N2 has a circular arc-shaped section. Accordingly, the fixing belt 610 passing through the roll nip portion N1 travels along the stripping pad nip portion. The traveling direction of the fixing belt 610 abruptly varies to be bent toward the tension roll 615. As a result, the sheet P passing through the roll nip portion N1 and the stripping pad nip portion N2 is stripped from the fixing belt 610 at the time when the sheet exits from the stripping pad nip portion N2, there stably performing the curvature stripping of the sheet P. In addition, in the fixing unit 60 according to the first exemplary embodiment, the stripping pad nip portion N2 has a width of 2.5 mm in the traveling direction of the fixing belt 610.

Here, the stripping pad 64 and the stripping pad nip portion N2 defined by the stripping pad 64 will be described in detail.

The stripping pad 64 is disposed in the vicinity of the downstream side from the roll nip portion N1 as described above. Accordingly, in the nip portion N including the roll nip portion N1 and the stripping pad nip portion N2, a valley region in which a nip pressure drops is prevented from occurring. Therefore, it is possible to set the nip pressure to monotonously and continuously decrease in a region where from a position (see FIG. 4) where the nip pressure peaks in the roll nip portion N1 to the most downstream position of the stripping pad nip portion N2.

Like the fixing unit 60 according to the first exemplary embodiment, when the fixing belt module 61 in which the fixing belt 610 is stretched on plural rolls including the fixing roll 611 is used as a heating member, it is possible to always maintain a predetermined fixing temperature in the fixing unit 60 even if the increase in speed of the image forming apparatus is intended as described later. In addition, it is possible to prevent the occurrence of a so-called "temperature dropping phenomenon" that the fixing temperature is dropped at the time of starting the high-speed fixing operation.

However, in the fixing unit 60 employing such a fixing belt module 61, the toner image is carried on the surface of the sheet P. As a result, when the toner image is fused by the heat of the fixing belt 610, an adhesive force between the sheet P and the fixing belt 610. Accordingly, it is necessary to provide a mechanism for stripping the sheet P from the surface of the fixing belt 610. Specifically, when the increase in speed of the image forming apparatus is intended and the stripping failure is generated in the fixing unit 60 to cause a jam of paper, the number of subsequent recording sheets which are damaged due to the affection of the paper jam increases. Therefore, it is necessary to stably strip the recording sheet passing through the nip portion N at a high speed from the fixing belt 610.

At this time, when a conventional stripping claw is used as the mechanism for stripping the sheet P from the surface of the fixing belt 61, the stripping claw should be necessarily disposed to come in contact with the fixing belt 610 in order to stably strip the sheet P from the fixing belt 610. Accordingly, since the surface of the fixing belt 610 can be easily worn out by the stripping claw, the following problems can be caused. That is, when a worn mark is generated on the surface of the fixing belt 610, a fixing stain corresponding to the worn mark can be generated on the fixed image, thereby deteriorating the image quality. In addition, the offset toners can be gradually deposited on the work mark, thereby causing contaminations on the fixed image. Furthermore, when the surface wear of the fixing belt 610 is further advanced, the thin fixing belt 610 can be finally destroyed, thereby damaging the function of the fixing unit 60. As a result, in order to perform the stripping of paper in the fixing belt module 61 using the fixing belt 610, the stripping mechanism using the curvature stripping is most suitable as described above.

Therefore, in the fixing belt module 61 according to the first exemplary embodiment, a member for abruptly varying the traveling direction of the fixing belt 610, that is, the stripping pad 64, is disposed at the downstream side from the nip portion N.

However, when the stripping pad nip portion N2 is formed successive to the roll nip portion N1 by disposing the stripping pad 64, a member for directly pressing the fixing belt 610 to the fixing roll 611 or the pressurization roll 62 does not exist in the boundary region N2S (see FIG. 3) between the roll nip portion N1 and the region where the stripping pad 64 is disposed in the stripping pad nip portion N2. Accordingly, in the boundary region N2S, the fixing belt 610 is brought into close contact with the pressurization roll 62 by only the tension of the fixing belt and thus the nip pressure in the boundary region N2S is formed by only the tension of the fixing belt 610. As a result, when the stripping pad 64 is disposed apart by a predetermined distance or more from the downstream end N1E (see FIG. 3) of the roll nip portion N1, the nip pressure in the boundary region N2S decreases between the nip pressure of the roll nip portion N1 and the nip pressure of the region in which the stripping pad 64 is disposed, thereby generating the drop in nip pressure (valley in nip pressure). That is, a region in which the nip pressure is relatively low is formed in the upstream area in the stripping pad nip portion N2.

Figure 4:
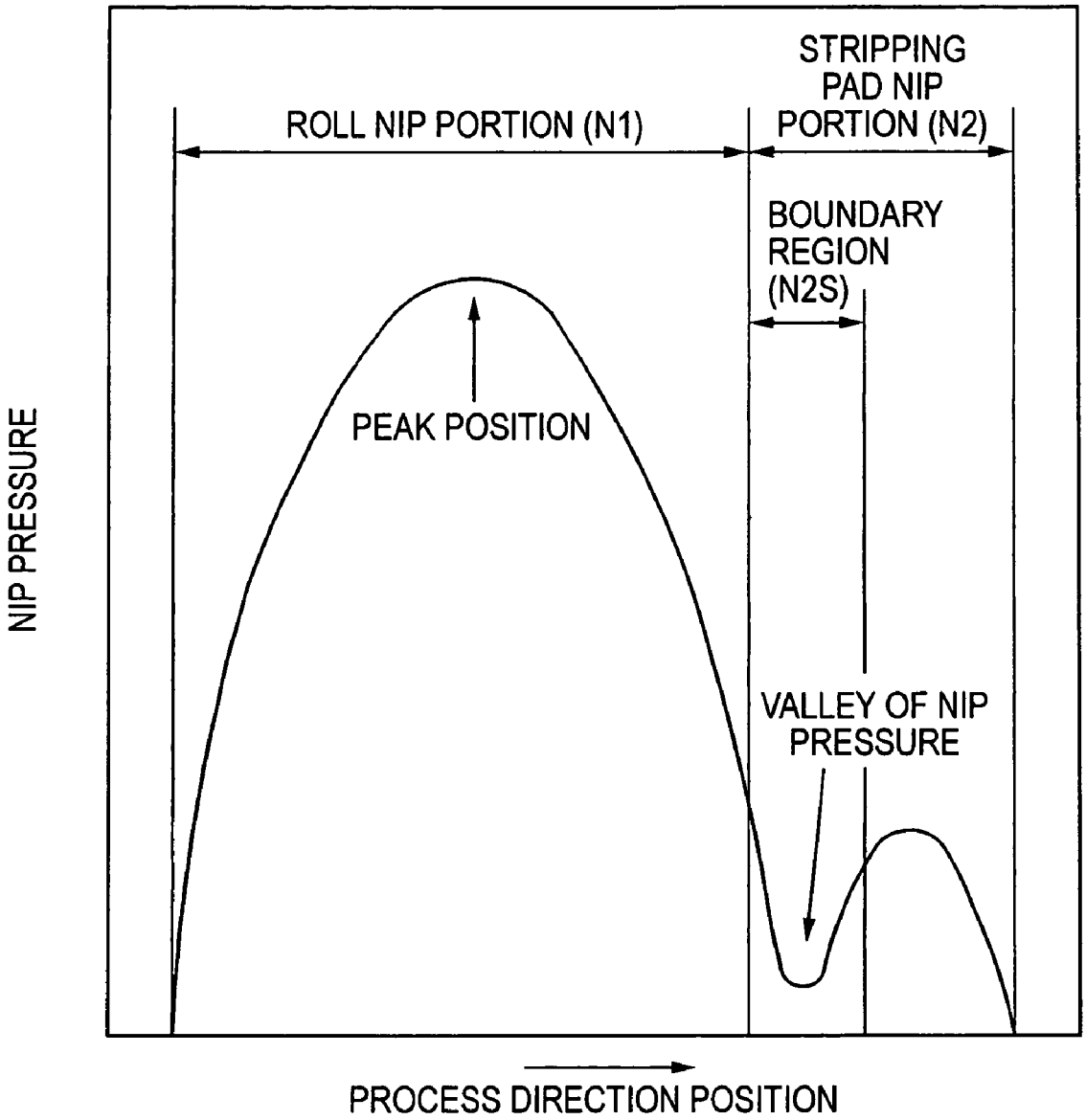
FIG. 4 is a diagram schematically illustrating a nip pressure distribution when a stripping pad is disposed apart by a predetermined distance from a downstream end of a roll nip portion.

FIG. 4 is a diagram schematically illustrating a nip pressure distribution in the nip portion N (the roll nip portion N1 and the stripping pad nip portion N2) when the stripping pad 64 is disposed apart by a predetermined distance or more from the downstream end N1E of the roll nip portion N1. As shown in FIG. 4, in this case, a valley region in which the nip pressure drops is formed in the boundary region N2S to the roll nip portion N1 in the stripping pad nip portion N2.

In the fixing process performed by the fixing unit 60 according to the first exemplary embodiment, the sheet P carrying the toner image is heated and pressed in the roll nip portion N1 and thus the toner is fused and fixed. At this time, in the sheet P or the toner heated in the roll nip portion N1, moisture in the sheet P is vaporized into steam or air in the toner is thermally expanded. However, since a high nip pressure acts in the roll nip portion N1, the steam or the air gaps (bubbles) resulting from the expanded air are not generated between the fixing belt 610 and the pressurization roll 62.

However, when a region having a low nip pressure is formed in the boundary region N2S to the roll nip portion N1 in the stripping pad nip portion N2, the bubbles suppressed in the roll nip portion N1 may be generated without being suppressed in the boundary region N2S. When the sheet P enters a region having a high nip pressure in which the stripping pad 64 in the state that the bubbles are generated, the bubbles generated in the boundary region N2S strays on the surface of the sheet P due to the high nip pressure. However, since the fused toner is not completely solidified right after the toner image on the sheet P passes through the roll nip portion N1, the toner image can be disturbed due to the straying of the bubbles. As a result, there is caused a problem that image defects such as stains occur in the fixed image.

Therefore, in the fixing unit 60 according to the first exemplary embodiment, the stripping pad 64 is disposed in the vicinity of the downstream side from the roll nip portion N1. In this way, by disposing the stripping pad 64, the width of the boundary region N2S between the roll nip portion N1 and the region in which the stripping pad 64 is disposed in the stripping pad nip portion N2 can be set as small as possible.

Figure 5:
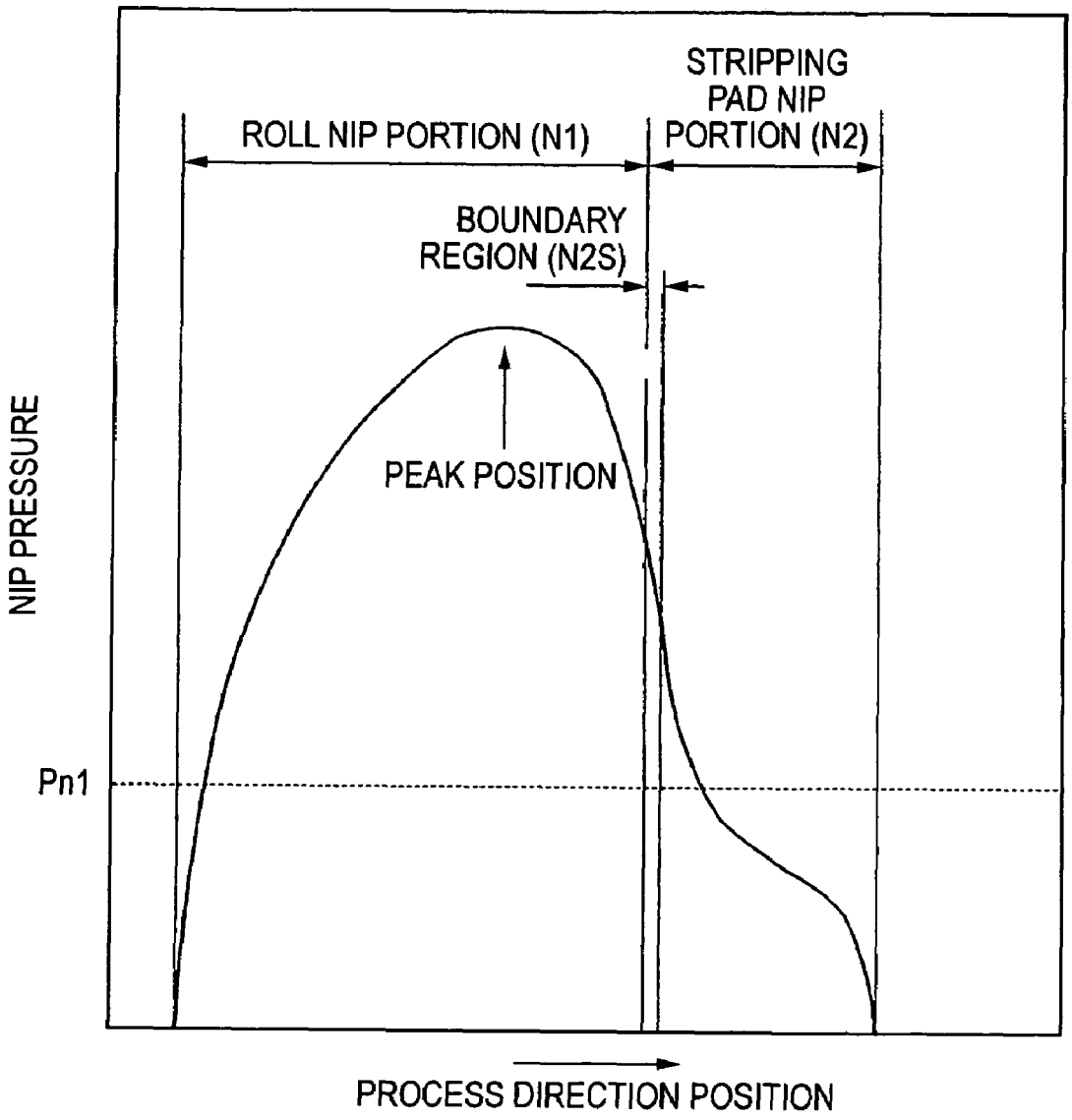
FIG. 5 is a diagram schematically illustrating a nip pressure distribution when the stripping pad is disposed in the vicinity of the downstream side of the roll nip portion.

Accordingly, the region in which the fixing belt 610 is pressed to the pressurization roll 62 with only the tension of the fixing belt is narrowed. As a result, as shown in FIG. 5 (which is a diagram schematically illustrating the nip pressure distribution when the stripping pad 64 is disposed in the vicinity of the downstream side from the roll nip portion N1), it is possible to prevent the occurrence of the valley region in which the nip pressure drops in the boundary region N2S. That is, the nip pressure can be set to monotonously and continuously decrease in the region from the position where the nip pressure peaks in the roll nip portion N1 of the nip portion N to the most downstream position of the stripping pad nip portion N2.

In this way, by setting the nip pressure to monotonously and continuously decrease in the region from the position where the nip pressure peaks in the roll nip portion N1 of the nip portion N to the most downstream position of the stripping pad nip portion N2, steam suppressed by the high nip pressure in the roll nip portion N1 or air to be thermally expanded can be gradually opened in the path until the sheet passes through the stripping pad nip portion N2, thereby preventing the occurrence of a phenomenon that the bubbles stray. Accordingly, the toner image which is not solidified completely is hardly disturbed, thereby preventing the occurrence of image defects such as image stains in the fixed image.

Next, the shape of the stripping pad 64 which is disposed in the vicinity of the downstream side from the roll nip portion N1 will be described.

As shown in FIG. 3, the stripping pad 64 includes an inside surface 64*a* facing the fixing roll 611, an outside surface 64*b* for abruptly varying the traveling direction of the fixing belt 610 passing through the stripping pad nip portion N2, and a pressing surface 64*c* for pressing the fixing belt 610 to the pressurization roll 62.

The inside surface 64*a* of the stripping pad 64 is formed in a curved surface corresponding to the circumferential surface of the fixing roll 611 so as to dispose the stripping pad 64 close to the fixing roll 611. That is, in order to set the boundary region N2S shown in FIG. 3 as narrow as possible, the stripping pad 64 should be necessarily disposed in the vicinity of the downstream side from the roll nip portion N1 so as to press the surface of the pressurization roll 62 in a wedge-shaped region Q (see FIG. 3) defined by the fixing roll 611 and the pressurization roll 62. Accordingly, the inside surface 64*a* is formed in a curved surface corresponding to the circumferential surface of the fixing roll 611, so that the upstream end (upstream end of the pressing surface 64*c*) of the inside surface 64*a* can be disposed in the vicinity of the downstream end N1E of the roll nip portion N1, that is, at a position close to the fixing roll 611 in the wedge-shaped region Q. On the other hand, in the stripping pad 64 according to the first exemplary embodiment, the inside surface 64*a* is formed in a circular circumferential surface having a radius of curvature of 33 mm.

In order to set the boundary region N2S as narrow as possible, the upstream end (upstream end of the pressing surface 64*c*) 64*p* of the inside surface 64*a* may be disposed to come in contact with the surface of the fixing roll 611.

The angle θ formed by a tangent line of the pressurization roll 62 and a tangent line of the outside surface 64*b* in the downstream end (a point where the fixing belt 610 is apart from the pressurization roll 62) 64*q* of the outside surface 64*b* is set to 40° or more, so that the outside surface 64*b* of the stripping pad 64 stably strips the sheet P from the fixing belt 610. The outside surface 64*b* is formed in a curved surface curved toward the outside (to the fixing belt 610) so that the fixing belt 610 smoothly travels toward the tension roll 615 and the fixing roll 611 after being stripped from the pressurization roll 62.

The pressing surface 64*c* of the stripping pad 64 is formed in a concave curved surface corresponding to the circumferential surface of the pressurization roll 62 so as to uniformly press the fixing belt 610 to the pressurization roll 62, but when the width of the pressing surface 64*c* is small, the pressing surface may be formed in a plane.

As described above, the upstream end 64*p* of the pressing surface 64*c* is disposed at a position close to the fixing roll 611 or at a position in which it comes in contact with the fixing roll 611 so as to narrow the width of the boundary region N2S between the roll nip portion N1 and the region in which the stripping pad 64 is disposed.

On the other hand, since the outside surface 64*b* and the pressing surface 64*c* come in frictional contact with the fixing belt 610, the surface thereof may be coated with Tefron (registered trademark).

FIG. 6 is a diagram illustrating an observation result of the image defects (defects such as image stains occurring on the fixed image due to occurrence of the bubbles) occurring on the fixed image when the sheet P carrying the non-fixed toner image is fed to the fixing unit 60 while changing the distance of the stripping pad 64 from the fixing roll 611 (a distance between the upstream end 64*p* of the pressing surface 64*c* and the fixing roll 611).

As shown in FIG. 6, when the distance between the stripping pad 64 and the fixing roll 611 is 1.0 mm or more, the occurrence of the image defects is observed. This is, it is considered, because when the distance between the stripping pad 64 and the fixing roll 611 is 1.0 mm or more, the steam or the thermally expanded air generated from the sheet P or the toner heated in the roll nip portion N1 appears without being completely suppressed in the boundary region N2S having the low nip pressure and the bubbles strays when the nip pressure is increased again in the stripping pad nip portion N2, thereby causing the image defects. Accordingly, from the result illustrated in FIG. 6, the distance of the stripping pad 64 from the fixing roll 611 should be necessarily set to 0.7 mm or less. In addition, in the first exemplary embodiment, the stripping pad 64 is disposed at a position apart by 0.5 mm from the fixing roll 611.

FIG. 7 is a diagram illustrating an observation result of image defects (defects such as image stains occurring on the fixed image due to the occurrence of bubbles) occurring on the fixed image when the sheet P carrying the non-fixed toner image is fed to the fixing unit 60 while changing the pressure ($N/cm^2$) with which the pressing surface 64*c* of the stripping pad 64 presses the pressurization roll 62 with the fixing belt 610 therebetween.

As shown in FIG. 7, when the pressure of the stripping pad 64 is 5 $N/cm^2$ or less in average, the occurrence of image defects is observed. This is, it is considered, because when the pressure of the stripping pad 64 is 5 $N/cm^2$ or less in average, the steam or the thermally expanded air strays without being completely suppressed in the stripping pad nip portion N2 including the boundary region N2S having the low nip pressure, thereby causing the image defects. Accordingly, from the result illustrated in FIG. 7, the pressure acting from the pressing surface 64*c* of the stripping pad 64 should be necessarily set to 7 $N/cm^2$ or more in average. The stripping pad 64 according to the first exemplary embodiment presses the pressurization roll 62 with the fixing belt 610 therebetween with a pressure of 10 kgf and the width of the pressing surface 64*c* is 2 mm.

In this way, in the fixing unit 60 according to the first exemplary embodiment, the nip portion N including the roll nip portion N1 and the stripping pad nip portion N2 is formed in a region where the fixing belt module 61 and the pressurization roll 62 come in close contact with each other. The stripping pad 64 defining the stripping pad nip portion N2 is disposed in the vicinity of the downstream side from the roll nip portion N1 and presses the pressurization roll 62 with the pressure greater than or equal to a predetermined value. Accordingly, a valley region having a low nip pressure can be prevented from occurring in the nip portion N and thus the nip pressure can be set to monotonously and continuously decrease in the region from the position where the nip pressure peaks in the roll nip portion N1 of the nip portion N to the most downstream position of the stripping pad nip portion N2.

In this way, by setting the nip pressure to monotonously and continuously decrease, the steam suppressed by the high nip pressure in the roll nip portion N1 or the air to be thermally expanded can be gradually opened in a path until the sheet passes through the stripping pad nip portion N2, thereby preventing the occurrence of a phenomenon that the steam or the thermally expanded air strays as bubbles in the nip portion. Accordingly, the toner image which is not solidified completely is hardly disturbed, thereby preventing the occurrence of image defects such as image stains in the fixed image.

In addition, since the stripping pad 64 defining the stripping pad nip portion N2 has a circular arc-shaped section, the traveling direction of the fixing belt 610 passing through the stripping pad nip portion N2 varies abruptly. Accordingly, the sheet P having passed through the roll nip portion N1 and the stripping pad nip portion N2 is stripped from the fixing belt 610 at the time when the sheet exits from the stripping pad nip portion N2 and the curvature stripping of the sheet P can be stably performed.

Next, a fixing operation of the fixing unit 60 according to the first exemplary embodiment will be described.

The sheet P to which the non-fixed toner image is transferred in the secondary transfer unit 20 (see FIG. 1) of the image forming apparatus is fed toward the nip portion N of the fixing unit 60 (the arrow F direction in FIG. 2) through the feed belt 55 and the fixing entrance guide 56. The non-fixed toner image on the surface of the sheet P passing through the nip portion N is fixed to the sheet P by the use of the pressure and heat acting mainly in the roll nip portion N1.

At this time, in the fixing unit 60 according to the first exemplary embodiment, the heat acting in the nip portion N is supplied mainly from the fixing belt 610. The fixing belt 610 performs the heating process by the use of the heat supplied through the fixing roll 611 from the halogen heater 616*a* disposed in the fixing roll 611, the heat supplied through the tension roll 612 from the halogen heater 616*b* disposed in the tension roll 612, and the heat supplied through the tension roll 613 from the halogen heater 616*c* disposed in the tension roll 613. Accordingly, even when the thermal energy from the fixing roll 611 is not sufficient, the thermal energy can be supplied properly and rapidly from the tension roll 612 and the tension roll 613. As a result, in the nip portion N, it is possible to secure the sufficient amount of heat even when the process speed is a high speed of 300 mm/s.

That is, in the fixing unit 60 according to the first exemplary embodiment, the fixing belt 610 serving as a direct heating member can be formed with a very small heat amount. Furthermore, the fixing belt 610 comes in contact with the fixing roll 611, the tension roll 612, and the tension roll 613 as heat supply members in a wide wrap area (large wrap angle). Accordingly, for a short time when the fixing belt 610 circulates once, the sufficient heat amount can be supplied from the fixing roll 611, the tension roll 612, and the tension roll 613. Therefore, it is possible to return the fixing belt 610 to a necessary fixing temperature for a short time. As a result, even when the processing speed of the fixing unit 60 increases, it is possible to always maintain a predetermined fixing temperature in the nip portion N.

As a result, in the fixing unit 60 according to the first exemplary embodiment, it is possible to keep the fixing temperature substantially constant even at the time of the continuous feed of sheets. In addition, the temperature dropping phenomenon can be suppressed from occurring at the time of initiating the high-speed fixing operation. Specifically, when performing the fixing operation to thick sheets of paper having a great heat capacity, it is possible to maintain the fixing temperature and to suppress the temperature dropping from occurring. Furthermore, when it is necessary to change (including increase and decrease in fixing temperature) the fixing temperature in the course to correspond to the kinds of paper, the desired change in temperature can be performed easily and rapidly by adjusting the output of the halogen heater 616*a*, the halogen heater 616*b*, and the halogen heater 616*c*. This is possible because the heat capacity of the fixing belt 610 is small.

In the fixing unit 60 according to the first exemplary embodiment, the fixing roll 611 is a hard roll made of aluminum and the pressurization roll 62 is a soft roll coated with the elastic layer 622. Accordingly, since the fixing roll 611 is hardly deformed and the surface of the pressurization roll 62 is deformed, a nip region having a width in the traveling direction of the fixing belt 610 is formed in the roll nip portion N1. In this way, in the roll nip portion N1, the fixing roll 611 on which the fixing belt 610 is wrapped is hardly deformed. Accordingly, the fixing belt 610 can pass through the roll nip portion N1 while keeping the traveling speed of the fixing belt 610 constant. Therefore, since the wrinkles or distortions occurring in the fixing belt 610 in the roll nip portion N1 can be suppressed, it is possible to stably provide a fixed image with high quality.

Subsequently, the sheet P is fed to the stripping pad nip portion N2 after passing through the roll nip portion N1. In the stripping pad nip portion N2, the stripping pad 64 is pressed to the pressurization roll 62 and thus the fixing belt 610 comes in close contact with the pressurization roll 62. Accordingly, as shown in FIG. 3, the roll nip portion N1 has a curved shape convex downwardly in accordance with the curvature of the fixing roll 611, while the stripping pad nip portion N2 has a curved shape convex upwardly in accordance with the curvature of the pressurization roll 62.

As a result, the sheet P heated and pressed with the curvature of the fixing roll 611 in the roll nip portion N1 changes in the traveling direction to the curvature having the opposite direction due to the pressurization roll 62 in the stripping pad nip portion N2. At this time, a micro slip between the toner image on the sheet P and the surface of the fixing belt 610. Accordingly, the adhesive force between the toner image and the fixing belt 610 and thus the sheet P can be easily stripped from the fixing belt 610. In this way, the stripping pad nip portion N2 is positioned by the pre-process before surely performing the stripping in the final stripping process.

Since the fixing belt 610 travels to be wound around the stripping pad 64 at the exit of the stripping pad nip portion N2, the traveling direction of the fixing belt 610 varies abruptly. That is, since the fixing belt 610 is moved along the outside surface 64*b* of the stripping pad 64, the curve of the fixing belt 610 is great. Accordingly, the sheet P of which the adhesive force to the fixing belt 610 is weakened in advance in the stripping pad nip portion N2 can be satisfactorily stripped by itself from the fixing belt 61 due to the resilience of the sheet P.

In this way, the sheet P is stripped from the fixing belt 610 at the time of exiting from the stripping pad nip portion N2 and is stably stripped by curvature.

The sheet P stripped from the fixing belt 610 is discharged from the apparatus through the use of the sheet discharge guide 65 and the sheet discharge roll 66 and the fixing process is finished.

As described above, since the fixing unit 60 according to the first exemplary embodiment employs the fixing belt module 61 in which the fixing belt 610 as a heating member is stretched on plural rolls including the fixing roll 611, the fixing unit 60 can always maintain a predetermined fixing temperature, even when the image forming apparatus increases in speed. Furthermore, at the time of initiating the high-speed fixing operation, it is possible to suppress the occurrence of the temperature dropping phenomenon that the fixing temperature drops. Accordingly, it is possible to provide fixed images with high quality in mass for a short time.

In addition, the nip portion N includes the roll nip portion N1 and the stripping pad nip portion N2 successive to the roll nip portion N1. The stripping pad 64 is disposed in the vicinity of the downstream side from the roll nip portion N1 and presses the pressurization roll 62 with a pressing force greater than or equal to a predetermined value. Accordingly, a valley region in which the nip pressure decreases can be presented from occurring in the nip portion N and thus the nip pressure can be set to monotonously decrease continuously in the region from the position where the nip pressure peaks in the roll nip portion N1 to the most downstream position of the stripping pad nip portion N2.

In this way, by setting the nip pressure to monotonously decrease continuously, the steam suppressed by the high nip pressure in the roll nip portion N1 or the air to be thermally expanded can be gradually opened in the path until the sheet passes through the stripping pad nip portion N2, thereby preventing the occurrence of a phenomenon that the steam or the thermally expanded air strays as bubbles in the nip portion. Accordingly, the toner image which is not solidified completely is hardly disturbed, thereby preventing the occurrence of image defects such as image stains in the fixed image.

In addition, since the stripping pad 64 defining the stripping pad nip portion N2 has a circular arc-shaped section, the traveling direction of the fixing belt 610 passing through the stripping pad nip portion N2 varies abruptly. Accordingly, the sheet P having passed through the roll nip portion N1 and the stripping pad nip portion N2 can be stripped from the fixing belt 610 at the time when the sheet exits from the stripping pad nip portion N2, thereby stably performing the curvature stripping of the sheet P.

Second Exemplary Embodiment

In the first exemplary embodiment, the configuration that the pressurization roll 62 is used as the pressurization member disposed to come in close contact with the fixing belt module 61 in the fixing unit 60 mounted on an image forming apparatus has been described. In a second exemplary embodiment, a configuration that a pressurization belt module 70 in which a pressurization belt 700 is stretched on plural rolls is used as the pressurization member will be described. The same elements as the first exemplary embodiment are denoted by the same reference numerals and detailed description thereof is omitted herein.

Figure 8:
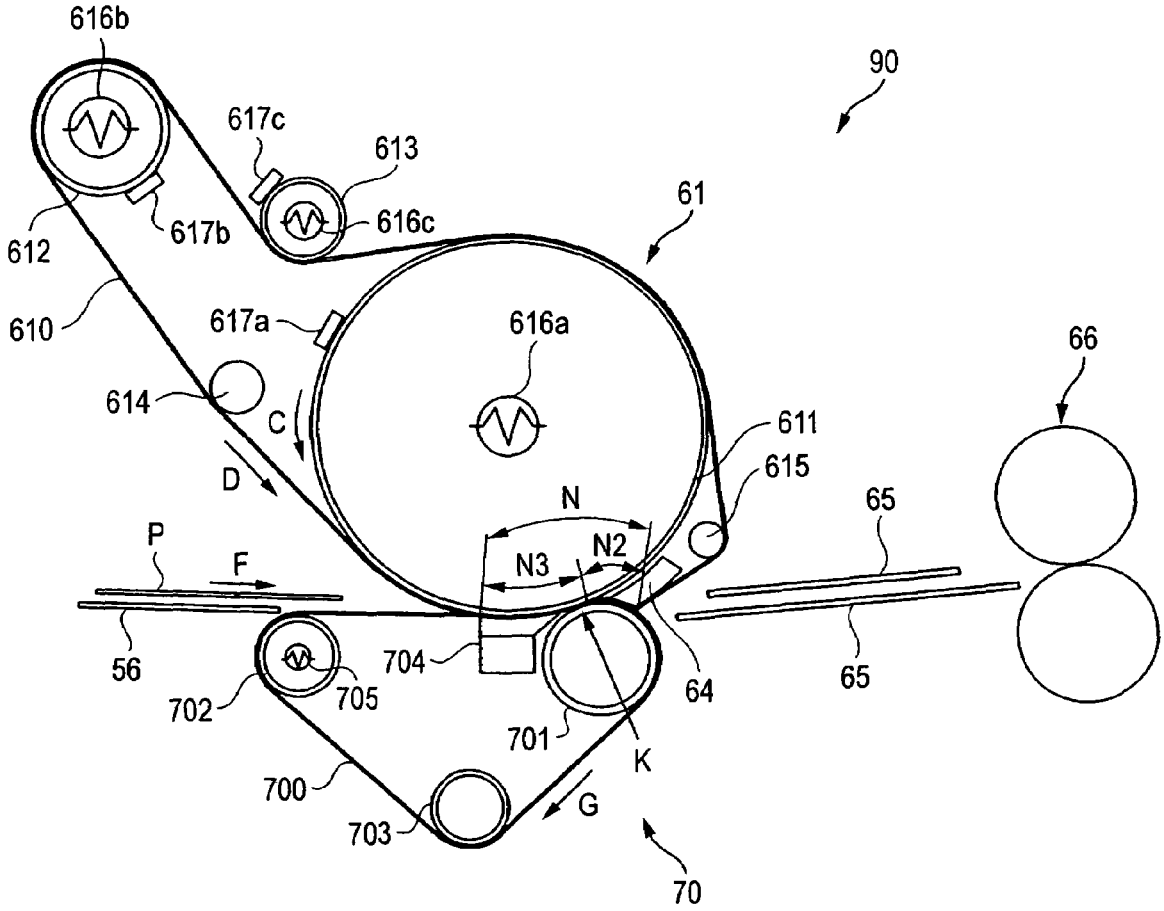
FIG. 8 is a side cross-sectional view schematically illustrating a configuration of a fixing unit according to a second exemplary embodiment.

FIG. 8 is a side cross-sectional view illustrating a configuration of a fixing unit 90 according to the second exemplary embodiment. The configuration of the fixing unit 90 according to the second exemplary embodiment is similar to that of the fixing unit 60 according to the first exemplary embodiment, except that the pressurization belt module 70 instead of the pressurization roll 62 is disposed as the pressurization member.

The pressurization belt module 70 according to the second exemplary embodiment includes a pressurization belt 700 stretched by three rolls of a pressurization roll 701, an inlet roll 702, and a tension roll 703 and a pressure pad 704 as a pressing member disposed to be biased to the fixing roll 611 with the pressurization belt 700 and the fixing belt 610 therebetween. The pressurization belt module 70 is disposed to be pressed to the fixing belt module 61 and the pressurization belt 700 circulates in the arrow G direction with the rotation of the fixing roll 611 as the fixing roll 611 of the fixing belt module 61 rotates in the arrow C direction. The traveling speed thereof is 300 mm/s, which is equal to the surface speed of the fixing roll 610.

In the nip portion N in which the pressurization belt module 70 and the fixing belt module 61 come in close contact with each other, a belt nip portion N3 in which the pressurization belt 700 comes in close contact with the outer circumferential surface of the fixing belt 610 is defined.

In the fixing unit 90 according to the second exemplary embodiment, the pressure pad 704 is disposed in the pressurization belt 700 to be biased to the fixing roll 611 with the pressurization belt 700 therebetween and thus presses the pressurization belt 700 to the wrap region of the fixing roll 611. At the most downstream portion of the belt nip portion N3, the pressurization roll 701 is biased to the central axis of the fixing roll 611 with the pressurization belt 700 and the fixing belt 610 therebetween by the use of a compression coil spring (not shown) as a bias member to generate a local high pressure in the contact portion between the fixing roll 611 and the fixing belt 610.

Accordingly, since the belt nip portion N3 can be formed wide, it is possible to embody a more stable fixing performance of the toner image on the sheet P. Since a pressure can be efficiently given to the fused toner image by the use of the local high pressure from the pressurization roll 701, a high fixing property can be obtained and the surface of the toner image can be smoothed, thereby giving excellent image gloss to color images.

Here, the pressurization belt 700 disposed in the pressurization belt module 70 includes a base layer made of resin having an excellent heat resistance such as polyimide, polyamide, and polyamideimide. The thickness of the base layer is in the range of, for example, 50 to 125 μm. The pressurization belt 700 can be a configuration that one surface of the base layer facing the fixing roll 611 or both surfaces thereof are coated with the detachment layer. In this case, fluorine resin such as PFA may be formed with a thickness of 5 to 20 μm as the detachment layer. Furthermore, the pressurization belt may have a stacked structure that an elastic layer is formed between the base layer and the detachment layer as needed. In this case, silicon rubber with a thickness of 100 to 200 μm can be used as the elastic layer. In the fixing unit 60 according to the second exemplary embodiment, the pressurization belt 700 includes only the base layer made of a polyimide film with a thickness of 75 μm, a width of 350 mm, and a circumferential length of 240 mm.

The three rolls stretching the pressurization belt 700 include the pressurization roll 701 in which a steel core is coated with silicon rubber as an elastic layer, the inlet roll 702 made of stainless steel, and the tension roll 703 made of stainless steel. The outer diameter of the pressurization roll 701 is 25 mm, the outer diameter of the inlet roll 702 is 22 mm, and the tension roll 703 is 20 mm. The length of the rolls is 360 mm. A halogen heater 705 as a heating source is disposed in the inlet roll 702. The surface temperature thereof is controlled to 120(C by a temperature sensor not shown and the control unit 40 (see FIG. 1) and the pressurization belt 700 is pre-heated.

The pressurization roll 701 is biased toward the central axis of the fixing roll 611 with the pressurization belt 700 and the fixing belt 610 therebetween by a compression coil spring (not shown) as a bias member, thereby generating a local high pressure in the contact portion between the fixing roll 611 and the fixing belt 610. In this case, in order to efficiently give the local high pressure to the fixing roll 611 and the fixing belt 610 with a low load, the pressurization roll 701 has a smaller diameter than that of the fixing roll 611.

A belt edge position detecting mechanism for detecting the belt edge position of the pressurization belt 700 and an axial displacement mechanism for displacing the contact position in the axial direction of the pressurization belt 700 in accordance with the detection result of the belt edge position detecting mechanism may be disposed in one roll of the pressurization roll 701, the inlet roll 702, and the tension roll 703, thereby controlling the meandering (belt walk) of the pressurization belt 700.

The pressure pad 704 as the pressing member includes an elastic member for securing a wide belt nip portion N3 and a low-friction layer disposed on the surface of the elastic member contacting the inner circumferential surface of the pressurization belt 700 and is held in a holder (not shown) made of metal. In the elastic member having the low-friction layer thereon, the surface facing the fixing roll 611 is formed in a concave shape corresponding to the outer circumferential surface of the fixing roll 610 and is disposed to press the fixing roll 611 to form an entrance region of the belt nip portion N3 formed in the wrap region of the fixing roll 611.

An elastic material such as silicon rubber and fluorine rubber having an excellent heat resistance can be used as the elastic member of the pressure pad 704. The low-friction layer formed on the elastic member serves to reduce the sliding resistance between the inner circumferential surface of the pressurization belt 700 and the pressure pad 704 and is preferably made of a material having a small friction coefficient and a wear resistance. Specifically, a glass fiber sheet, a fluorine resin sheet, and a fluorine resin film impregnated with Tefron (registered trademark) may be used.

In the fixing unit90 according to the second exemplary embodiment, a stripping pad 64 is disposed in the vicinity of the downstream side from the belt nip portion N3. The stripping pad 64 presses the fixing belt 610 onto the surface of the pressurization roll 62 with a pressing force greater than or equal to a predetermined value. Accordingly, the stripping pad nip portion N2 in which the fixing belt 610 is wound around the surface of the pressurization roll 62 is formed successive to the roll nip portion N1.

In addition, the stripping pad nip portion N2 defined by the stripping pad 64 prevents the occurrence of a valley region in which the nip pressure decreases can be presented from occurring in the nip portion N and thus the nip pressure can be set to monotonously decrease continuously in the region from the position where the nip pressure peaks in the roll nip portion N1 to the most downstream position of the stripping pad nip portion N2. In this way, by setting the nip pressure to monotonously and continuously decrease, the steam suppressed by a high nip pressure in the belt nip portion N3 or the air to be thermally expanded can be gradually opened in the path until the sheet passes through the stripping pad nip portion N2, thereby preventing the occurrence of a phenomenon that the steam or the thermally expanded air strays as bubbles in the nip portion. Accordingly, the toner image which is not solidified completely is hardly disturbed, thereby preventing the occurrence of image defects such as image stains in the fixed image.

In addition, since the stripping pad 64 defining the stripping pad nip portion N2 has a circular arc-shaped section, the traveling direction of the fixing belt 610 passing through the stripping pad nip portion N2 varies abruptly. Accordingly, the sheet P having passed through the belt nip portion N3 and the stripping pad nip portion N2 can be stripped from the fixing belt 610 at the time when the sheet exits from the stripping pad nip portion N2, thereby stably performing the curvature stripping of the sheet P.

Third Exemplary Embodiment

An image forming apparatus according to a third exemplary embodiment will be described in detail with reference to the accompanying drawings. Since the image forming apparatus according to the third exemplary embodiment has substantially the same configuration as the image forming apparatus shown in FIGS. 1 and 2 except the configuration of the stripping pad, the same elements are denoted by the same reference numerals and detailed description thereof is omitted.

Figure 9:
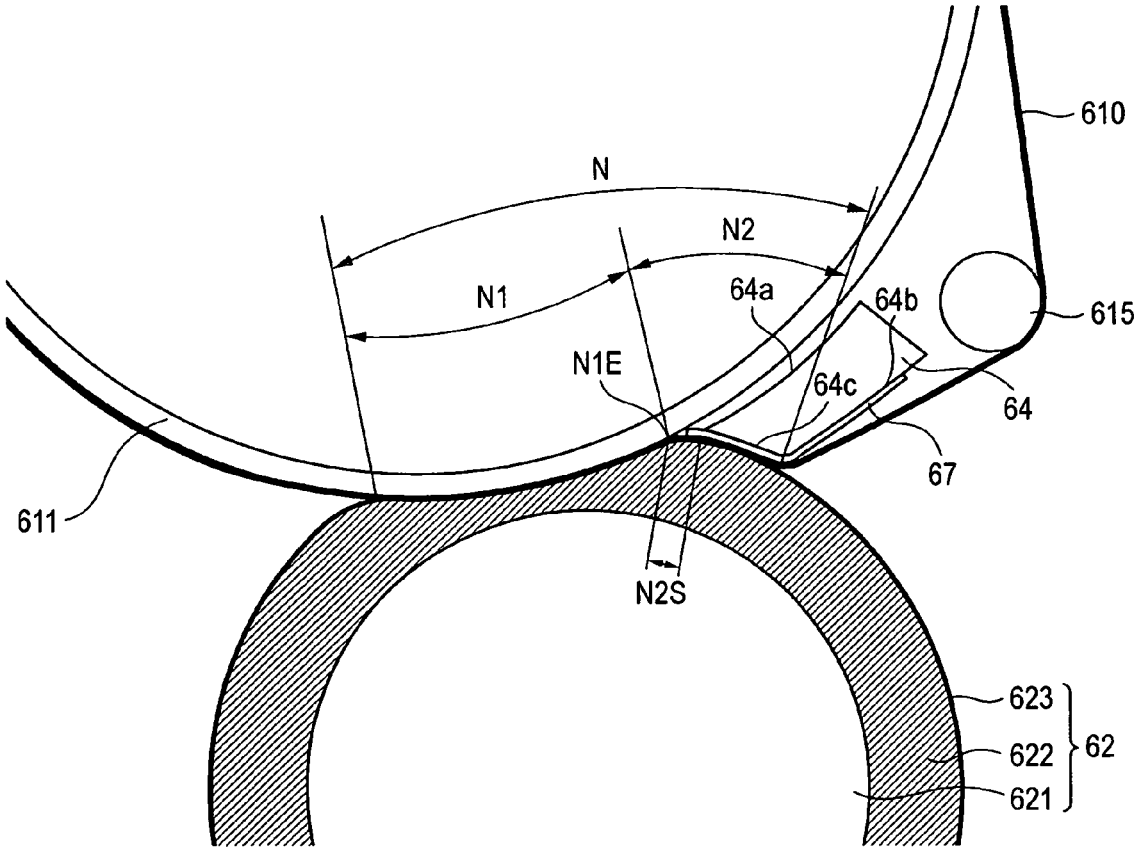
FIG. 9 is a diagram schematically illustrating the vicinity of a nip portion according to a third exemplary embodiment.

Now, the configuration of the stripping pad according to the third exemplary embodiment will be described. FIG. 9 is a schematic cross-sectional view illustrating the vicinity of the nip portion N in which the fixing belt module 61 and the pressurization roll 62 come in close contact with each other. As shown in FIG. 9, in the nip portion N in which the fixing belt module 61 and the pressurization roll 62 come in close contact with each other, a roll nip portion (a contact portion between a fixing roll 611 and a pressurization roll 62) N1 is formed in a region where a fixing belt 610 is wound around the fixing roll 611 by disposing the pressurization roll 62 to come in close contact with the outer surface of the fixing belt 610.

Here, in the fixing unit 60 according to the third exemplary embodiment, as described above, the fixing roll 611 as one roll forming the roll nip portion N1 is a hard roll formed by coating the surface of an aluminum core bar (core roll) with a heat-resistant resin (fluorine resin) and the fixing roll 611 is not coated with an elastic layer. The pressurization roll 62 as the other roll forming the roll nip portion N1 is a soft roll which is coated with an elastic layer 622.

By the fixing roll 611 and the pressurization roll 62, in the roll nip portion N1 according to the third exemplary embodiment, the roll nip portion N is formed by deforming the elastic layer 622 of the pressurization roll 62 and the pressurization roll 62 functions as a nip forming pressure roll. In other words, in the roll nip portion N1, the fixing roll 611 is hardly hollowed and only the surface of the pressurization roll 62 is hollowed (hollow degree of the pressurization roll 62>hollow degree of the fixing roll 611) to make a nip region having a predetermined width in a traveling direction of the fixing belt 510.

In the fixing unit 60 of the third exemplary embodiment, the fixing roll 611 at the side wrapped with the fixing belt 610 in the roll nip portion N1 is hardly deformed to maintain the cylindrical shape. As a result, the fixing belt 610 circulates along the circumferential surface of the fixing roll 611 and passes through the roll nip portion N1 while constantly maintaining a travel speed, because the radius of the circulation is not changed. Accordingly, even when the fixing belt 610 passes through the roll nip portion N1, it is difficult to generate wrinkles or distortion in the fixing belt 61. As a result, when the sheet P passes through the roll nip portion N1, confusion of the toner image is suppressed from being generated in the fixed image due to the wrinkles or the distortion of the fixing belt 610 and thus a good fixed image can be stably provided. In addition, the fixing unit 60 according to the third exemplary embodiment, the roll nip portion N1 is set to a width of 15 mm along the traveling direction of the fixing belt 610.

Next, a stripping pad 64 is disposed in the vicinity of the downstream side from the roll nip portion N1 and the stripping pad 64 presses the fixing belt 610 onto the surface of the pressurization roll 62 through a contact plate 67. As a result, a stripping pad nip portion (second nip portion) N2 in which the fixing belt 610 is wrapped around the surface of the pressurization roll 62 is continuously formed with the roll nip portion N1.

As shown in FIG. 3, the stripping pad 64 forming the stripping pad nip portion N2 is formed such that the section thereof has a circular arc shape, and is disposed along the axis direction of the fixing roll 611 in the vicinity of the downstream side from the roll nip portion N1. Furthermore, the fixing belt 610 after passing through the stripping pad nip portion N2 circulates along the side surface of the stripping pad 64. Accordingly, the traveling direction of the fixing belt 610 abruptly varies to be curved in the direction of a tension roll 615 by the stripping pad 64. As a result, the sheet P passing through the roll nip portion N1 and the stripping pad nip portion N2 cannot follow the variation in the traveling direction of the fixing belt 610 at the point that the sheet P gets out of the stripping pad nip portion N2 and the sheet P is stripped from the fixing belt 610 by so-called "resilience". Accordingly, at the exit of the stripping pad nip portion N2, curvature stripping of the sheet P is stably performed. In addition, in the fixing unit 60 according to the third exemplary embodiment, the stripping pad nip portion N2 is set to a width of 2.5 mm along the traveling direction of the fixing belt 610.

Here, the stripping pad nip portion N2 formed by the stripping pad 64 and the contact plate 67 will be described in detail.

The stripping pad 64 and the contact plate 67 are disposed in the vicinity of the downstream side from the roll nip portion N1, as mentioned above. As a result, in the nip portion N composed of the roll nip portion N1 and the stripping pad nip portion N2, a valley region in which the nip pressure falls below a predetermined value is suppressed from being generated in a region from a position in which the nip pressure has a peak value (see FIG. 7) to a most downstream position of the stripping pad nip portion N2 such that the nip pressure can continuously monotonous-decrease. As a result, in the fixing unit 60 according to the third exemplary embodiment, stable sheet detachment can be realized and a high-quality fixed image without image defects such as stains can be provided. Hereinafter, a case where the valley region in which the nip pressure falls below the predetermined value is suppressed from being generated by the stripping pad 64 and the contact plate 67 disposed in the vicinity of the roll nip portion N1 such that the nip pressure can continuously monotonous-decrease in the nip portion N will be described.

First, in the fixing unit 60 according to the third exemplary embodiment, a fixing belt module 61 in which the fixing belt 610 is stretched by plural rolls including the fixing roll 611 is used as a heating member. The configuration using such a fixing belt module 61 has excellent characteristics that a predetermined fixing temperature of the fixing unit 60 can be always maintained even in a case where the high speed of the image forming apparatus can be realized and a "temperature drooping phenomenon" which a fixing temperature drops can be suppressed from being generated at the time of starting a high-speed fixing operation.

However, even in the fixing unit 60 using such a fixing belt module 61, since the toner image is carried on the surface of the sheet P, the toner image functions as an adhesive and thus an adhesive force is generated between the sheet P and the fixing belt 610. As a result, similar to the conventional fixing unit, a mechanism for stripping the sheet P from the surface of the fixing belt 610 need not be provided. In particular, in a case where the high speed of the image forming apparatus is realized, when detachment defects are generated in the fixing unit 60 to generate a paper jam, the number of the subsequent sheets P damaged due to the paper jam more increases. Thus, the sheet P passing through the nip portion N at a high speed need be stably and surely stripped from the fixing belt 610.

At this time, when the stripping claw is used as the mechanism for stripping the sheet from the surface of the fixing belt 610, it is necessary to dispose the stripping claw in contact with the fixing belt so as to stably detach the sheet from the fixing belt 610. As a result, in a case of using the stripping claw, the surface of the fixing belt 610 can be easily worn out by the stripping claw and thus a possibility of causing the following problems is high. In other words, a worn mark is generated on the surface of the fixing belt 610, and a fixing stain corresponding to the worn mark on the surface of the fixing belt 610 can be generated on a fixed image, thereby deteriorating image quality. In addition, toners offset onto the worn mark can be gradually deposited, thereby generating contaminations on the fixed image. Furthermore, when the wear of the fixing belt 610 is advanced, the thin fixing belt 610 may be finally destroyed, thereby damaging the function of the fixing unit. As a result, in order to perform the sheet detachment in the fixing belt module 61 using the fixing belt 610, a detachment mechanism using the curvature stripping, which does not require a contact member such as the stripping claw, is most suitable, as mentioned above.

Accordingly, in the fixing belt module 61 according to the third exemplary embodiment, a member for abruptly changing the traveling direction of the fixing belt 610, that is, the stripping pad 64 is disposed at the downstream of the nip portion N.

Figure 10:
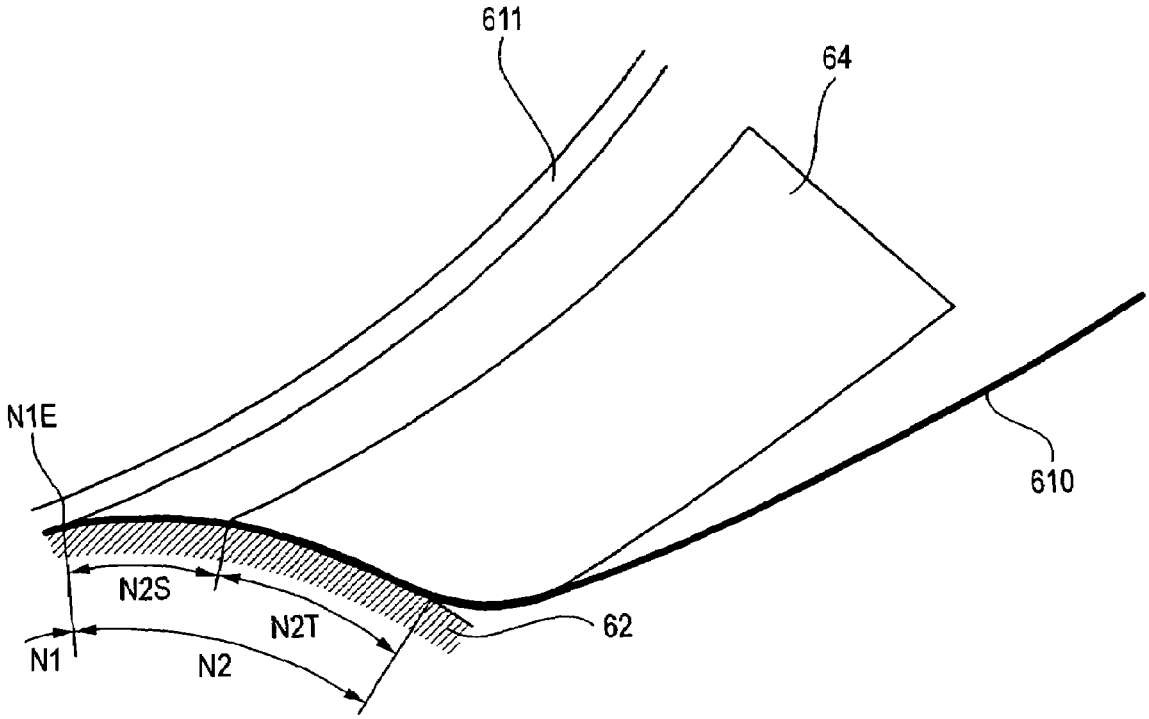
FIG. 10 is a diagram illustrating an area surrounding a stripping pad when only the stripping pad is disposed apart by a predetermined distance from a roll nip portion.

Here, FIG. 10 is a diagram illustrating an area surrounding a stripping pad 64 when only the stripping pad 64 is disposed apart by a predetermined distance from a roll nip portion N1. As shown in FIG. 10, even in a case where only the stripping pad 64 is disposed apart by the predetermined distance from the roll nip portion N1, the stripping pad nip portion N2 is continuously formed with the roll nip portion N1 at the downstream side from the roll nip portion N1, as mentioned above. However, in this case, in the region of the stripping pad nip portion N2, a boundary region (intermediate region) N2S in which a member for directly pressing the fixing belt 610 does not exist at any one of the fixing roll 611 and the pressurization roll 62 is formed between the roll nip portion N1 and a region in which the stripping pad 64 is disposed (the contact member between the stripping pad 64 and the pressurization roll 62) N2T. As a result, in the boundary region N2S, the fixing belt 610 comes in close contact with the pressurization roll 62 only by the tension of the fixing belt 610 and the nip pressure at the boundary region N2S is formed only by the tension of the fixing belt 610. Accordingly, when the stripping pad 64 is disposed apart by at least the predetermined distance from the downstream end N1E (See FIG. 9) of the nip portion N1, the nip pressure of the boundary region N2S becomes a valley between the nip pressure of the roll nip portion N1 and the nip pressure at the region N2T in which the stripping pad 64 is disposed and thus the drop of the nip pressure (valley of the nip pressure) is generated. In other words, a region having a nip pressure Pn lower than the below-mentioned predetermined nip pressure Pn1 is formed at the upstream region (the boundary region N2S with the roll nip portion N1) in the stripping pad nip portion N2.

Figure 11:
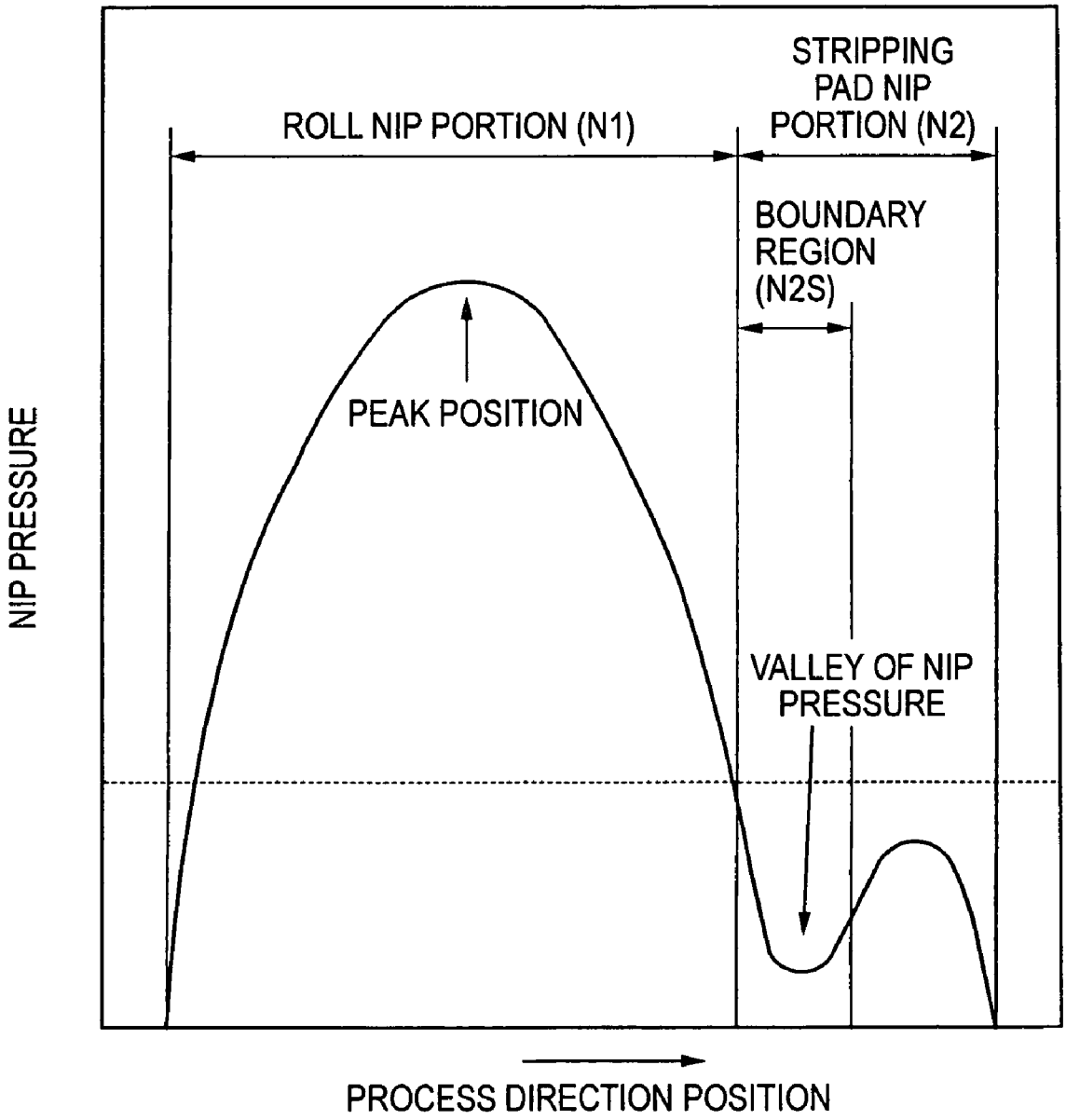
FIG. 11 is a diagram schematically illustrating a nip pressure distribution when the stripping pad is disposed apart by a predetermined distance from the downstream end of the roll nip portion.

Here, FIG. 11 is a diagram schematically illustrating a nip pressure distribution of the nip portion N (the roll nip potion N1 and the stripping pad nip portion N2) when the stripping pad 64 is disposed apart by at least a predetermined distance from the downstream end of the roll nip portion N1. As shown in FIG. 11, in this case, in the stripping pad nip portion N2, a valley region having the nip pressure Pn lower than the predetermined nip pressure Pn1 is formed at the boundary region N2S of the roll nip portion N1.

In the fixing process using the fixing unit 60 according to the third exemplary embodiment, the sheet P carrying the toner image is heated and pressed in the roll nip portion N1 and thus the toner is fused and fixed. At this time, in the sheet P or the toner heated in the roll nip portion N1, moisture in the sheet P is vaporized into steam or air in the toner is thermally expanded. However, since a high nip pressure acts in the roll nip portion N1, the steam or the air gaps (bubbles) resulting from the expanded air is not generated between the fixing belt 610 and the pressurization roll 62.

However, when the nip pressure Pn is lower than the predetermined nip pressure Pn1 in the boundary region N2S of the roll nip portion N1 in the stripping pad nip portion N2, the bubbles are suppressed in the roll nip portion N2, but occur in the boundary region N2S. In addition, in the state of generating the bubbles, when the sheet P enters the region N2T in which the stripping pad 64 is disposed and which has a high nip pressure, the bubbles which occur in the boundary region N2S are floated above the sheet P by the high nip pressure. Accordingly, the toner image on the sheet P can be easily disturbed because the bubbles are floated in the state that the fused toner is not completely fixed immediately after passing through the roll nip portion N1. As a result, image defects such as stains may be easily generated in a fixed image, thereby causing the deterioration in image quality.

Accordingly, in the fixing unit 60 according to the third exemplary embodiment, the stripping pad 64 is disposed in the vicinity of the downstream side from the roll nip portion N1, and, in the boundary region N2S with the roll nip portion N1 in the region of the stripping pad nip portion N2, a contact plate 67 is disposed as a member for pressing the fixing belt 610 to the pressurization roll 62.

Figure 12:
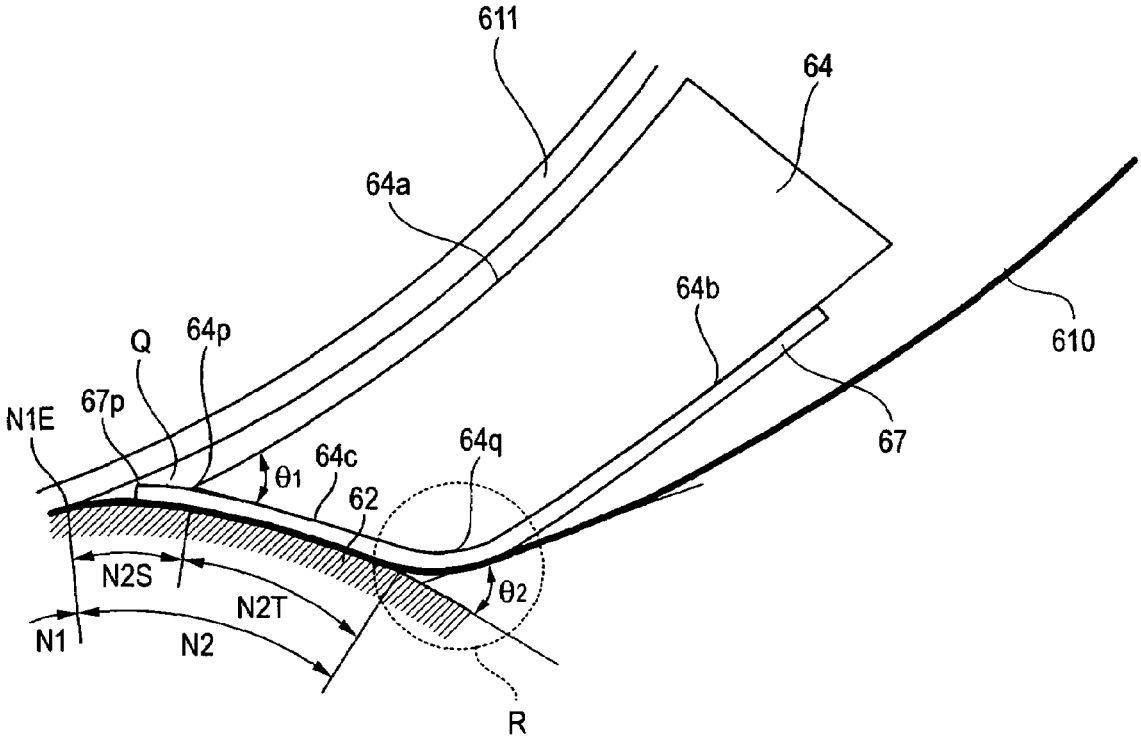
FIG. 12 is a diagram illustrating an area surrounding the stripping pad when the stripping pad is disposed in the vicinity of the downstream side of the roll nip portion and a contact plate is disposed.

FIG. 12 is a diagram illustrating an area surrounding the stripping pad 64 when the stripping pad 64 is disposed in the vicinity of the downstream side from the roll nip portion N1 and the contact plate 67 is disposed. As shown in FIG. 12, by disposing the stripping pad 64 and the contact plate 67, it is possible to set a width between the roll nip portion N1 in the stripping pad nip portion N2 and the region N2T in which the stripping pad 64 is disposed to a very small value. Simultaneously, in the boundary region N2S, it is possible to directly press the fixing belt 610 onto the pressurization roller 62 by the contact plate 67. Accordingly, a region in which the fixing belt 610 comes in close contact with the pressurization roll 62 only by the tension of the fixing belt 610 can become significantly narrower.

Figure 13:
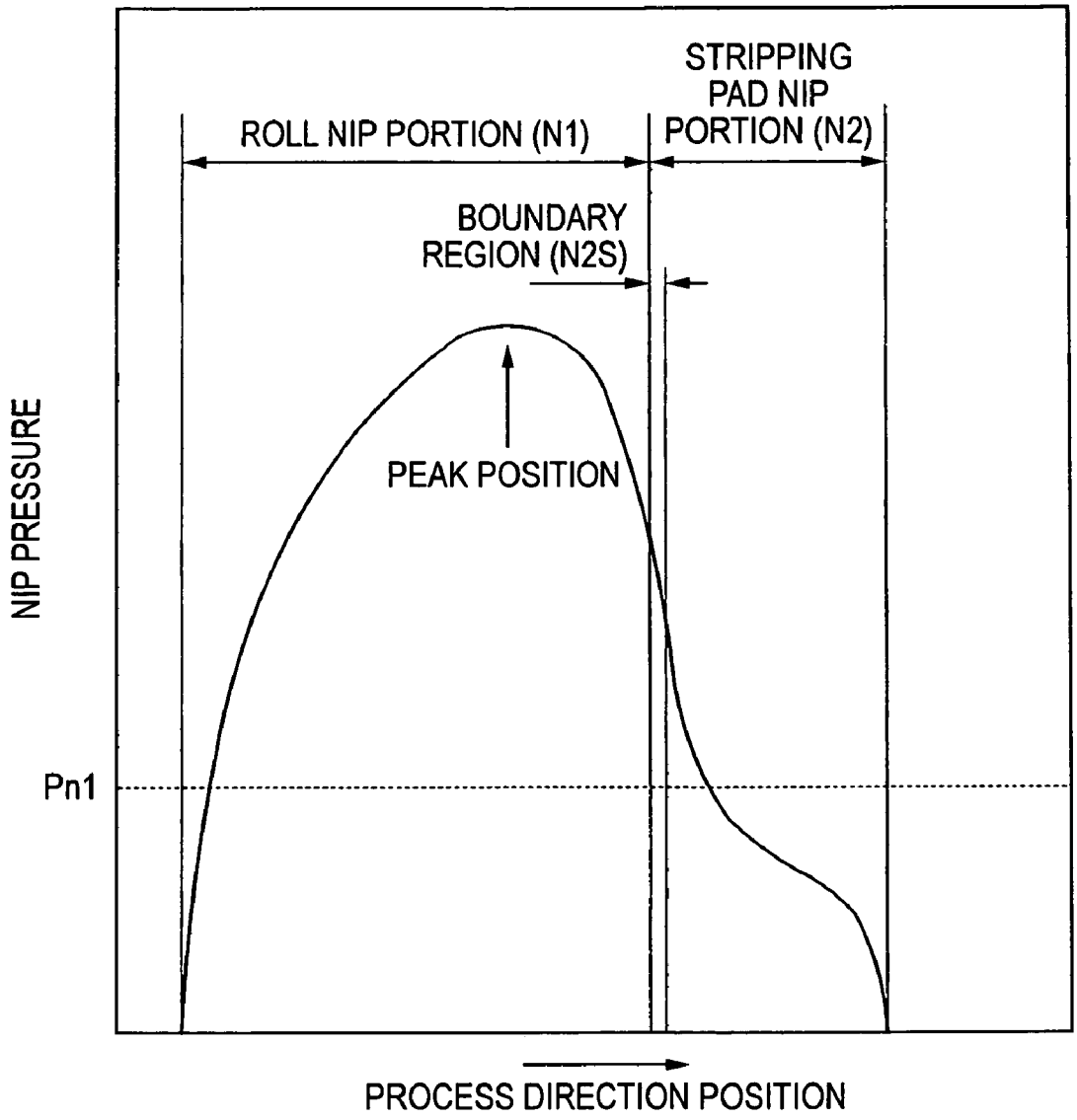
FIG. 13 is a diagram schematically illustrating a nip pressure distribution when the stripping pad is disposed in the vicinity of the downstream side of the roll nip portion and the contact plate is disposed.

Accordingly, as shown in FIG. 13 (diagram schematically illustrating a nip pressure distribution when the stripping pad 64 is disposed in the vicinity of the downstream side from the roll nip portion N1 and the contact plate 67 is disposed), a valley region having the nip pressure Pn lower than the predetermined nip pressure Pn1 can be suppressed from being generated in the boundary region N2S. In other words, it is possible to set the nip pressure Pn of the boundary region N2S higher than the predetermined nip pressure Pn1. In addition, it is possible to set the nip pressure which continuously monotonous-decreases in a region from a position in which the nip pressure becomes a peak value in the nip portion N1 to a most downstream position of the stripping pad nip portion N2 in the nip portion N.

Since the nip pressure Pn of the boundary region N2S is set to be higher than the predetermined nip pressure Pn1, the bubbles can be suppressed from occurring in the boundary region N2S. Furthermore, by setting the nip pressure which continuously monotonous-decreases in a region from a position in which the nip pressure becomes a peak value in the nip portion N1 to a most downstream position of the stripping pad nip portion N2 in the nip portion N, steam suppressed by the high nip pressure or air to be thermally expanded in the roll nip portion N1 is gradually opened in a path until passing through the stripping pad nip portion N2. Accordingly, since it is possible to suppress the bubbles from being floated as mentioned above, the toner image which is not fixed is hardly disturbed and thus image defects such as stains can be suppressed from being generated in a fixed image.

Here, in order to prevent bubbles from occurring in the boundary region N2S, the pressure (nip pressure) Pn in the boundary region N2S should necessarily satisfy the following expression.

$$Pn \geqq Pox(Tn/To-1) \quad (1)$$

That is, the predetermined nip pressure Pn1 is as follows.

$$Pn1=Pox(Tn/To-1)$$

Here, Tn denotes an absolute temperature of the fixing belt 610, To denotes an absolute temperature (environmental temperature) of air at a position sufficiently apart from the fixing roll 611, and Po denotes an atmospheric pressure.

Expression (1) is derived as follows. First, the ideal gas equation of state is expressed by the following expression.

$$PV=nRT \quad (2)$$

Here, P denotes pressure, V denotes a volume, n denotes the number of moles, R denotes a gas constant, and T denotes an absolute temperature. Accordingly, the following expressions are derived.

$$(Po+Pn)\times Vn=nRTn \quad (3)$$

$$PoVo=nRTo \quad (4)$$

Here, Vn denotes a volume of the bubbles in the boundary region N2S and Vo denotes a volume of the bubbles under atmospheric pressure. In order to suppress the bubbles from occurring in the boundary region N2S, a condition of $Vn \leqq Vo$ must be satisfied. Accordingly, the following expression is derived from Expressions 3 and 4.

$$Tn/(Po+Pn)<(To/Po \quad (5)$$

Expression (1) is derived by modifying Expression (5).

In addition, the contact plate 67 brings the fixing belt 610 into close contact with the pressurization roll 62 so as to embody the nip pressure Pn satisfying Expression (1).

Next, the shape of the stripping pad 64 disposed in the vicinity of the downstream side from the roll nip portion N1 will be described.

As shown in FIG. 12, in the stripping pad 64, an internal surface 64*a* facing the fixing roll 611, and an external surface 64*b* for abruptly varying the traveling direction of the fixing belt 610 passing through the stripping pad nip portion N2, and a pressing surface for pressing the fixing belt 610 onto the pressurization roll 62 through the contact plate 67 are formed.

The internal surface 64*a* of the stripping pad 64 is formed in a curved surface along the circumferential surface so as to bring the stripping pad 64 into close contact with the fixing roll 611 (for example, a gap between the stripping pad 64 and the fixing roll 611 is 0.5 mm). In other words, in order to make the boundary region N2S shown in FIG. 12 narrower, the stripping pad 64 need be disposed to press the surface of the pressurization roll 62 in a wedge-shaped region Q defined by the fixing roll 611 and the pressurization roll 62 in the vicinity of the downstream side from the roll nip portion N1 (See FIG. 9). Accordingly, the internal surface 64*a* is formed in a curved surface along the circumferential surface of the fixing roll 611 such that an upstream end 64*p* of the internal surface 64*a* (upstream end of the pressing surface 64*c*) is disposed in the vicinity of a downstream end N1E of the roll nip portion N1, that is, at a position close to the fixing roll 611 in the wedge-shaped region Q. In addition, in the stripping pad 64 according to the third exemplary embodiment, the internal surface 64*a* is approximately formed in a circumferential surface having the radius of curvature of 33 mm.

In addition, in order to dispose the upstream end 64*p* of the internal surface 64*a* in the vicinity of the fixing roll 611 in the wedge-shaped region Q, an angle between the internal surface 64*a* and the pressing surface 64*c* is preferably 20 to 50 degrees.

The external surface 64*b* of the stripping pad 64 is set such that an angle θ2 (See FIG. 12) between a tangent line of the pressurization roll 62 and a tangent line of the external surface 64*b* becomes at least 40 degrees in an upstream end region R of the external surface 64*b* (region in which the fixing belt 610 is spaced apart from the pressurization roll 62) so as to stably strip the sheet P from the fixing belt 610. In addition, the shape of the external surface 64*b* is formed in a plane sloped toward a tension roll 615 such that the fixing belt 610 is spaced apart from the pressurization roll 62 and then advances toward the tension roll 615 and the fixing roll 611. In this case, the external surface 64*b* may be formed in a curved surface toward the outside (the side of the fixing belt 610).

The pressing surface 64*c* of the stripping pad 64 is formed in a plane so as to uniformly press the fixing belt 610 onto the pressurization roll 62 through the contact plate 67. In addition, the pressing surface 64*c* may be formed in a concave-shaped curved surface along the circumferential surface of the pressurization roll 62 so as to accomplish the uniformity of the pressing force.

As mentioned above, the contact plate 67 is a plate-shaped member formed in a metal thin plate (having a thickness of about 0.1 mm) such as SUS and is formed in a shape following the external surface 64*b* and the pressing surface 64*c* of the stripping pad 64, as shown in FIG. 12. In addition, the stripping pad 64 is fixed in the external surface 64*b* of the stripping pad 64, but the contact plate 67 is not fixed and the upstream end 67*p* is set to a free end in the pressing surface 64*c* of the stripping pad 64. Furthermore, the upstream end 67*p* of the contact plate 67 is formed to be protruded from the upstream end 64*p* of the stripping pad 64. Further, in the state that the stripping pad 64 is not pressed toward the pressing roll 62, a gap is generated between the contact plate 67 and the pressing surface 64*c* of the stripping pad 64. In other words, in a case where the stripping pad 64 is stripped from the fixing unit 60, a portion of the contact plate 67 positioned at the pressing surface 64*c* is applied with spring elasticity using a downstream end region 64*q* of the pressing surface 64*c* as a supporting point.

In addition, by disposing the stripping pad 64 to be pressed onto the pressurization roll 62, the contact plate 67 is pressed onto the pressurization roll 62. In this case, since the contact plate 67 is formed of the plate-shaped member made of a metal thin plate, the contact plate 67 can easily enter the narrow wedge-shaped region defined by the fixing roll 611 and the pressurization roll 62. In addition, the contact plate 67 brings the fixing belt 610 into close contact with the pressurization roll 62 over the entire area including the boundary region N2S of the roll nip portion N1 of the stripping pad nip portion N2 by the spring elasticity using the downstream end region 64*q* of the pressing surface 64*c* as the supporting point. Accordingly, it is possible to form the nip pressure Pn satisfying Expression (1) in a deep point of the wedge-shaped region Q of the boundary region N2S.

However, in the configuration shown in FIG. 12, the spring elasticity of the contact plate 67 is applied by a so-called "cantilever support" for fixing one surface of the contact plate 67 (a portion positioned at the external surface 64*b* of the stripping pad 64) to the stripping pad 64 to bring the fixing belt 610 into close contact with the pressing roll 62. Meanwhile, instead of this configuration, a so-called "both-ends support" in which the upstream end 67*p* of the contact plate 67 comes in close contact with the fixing roll 611 and the upstream end 67*p* receives the pressing force from the fixing roll 611 may be employed. By this configuration, in the boundary region N2S, the upstream side from the contact plate 67 is pressed from the fixing roll 611 and the downstream side from the contact plate 67 is pressed from the stripping pad 64 such that the nip pressure at the boundary region N2S can be more stably formed.

Figure 14:
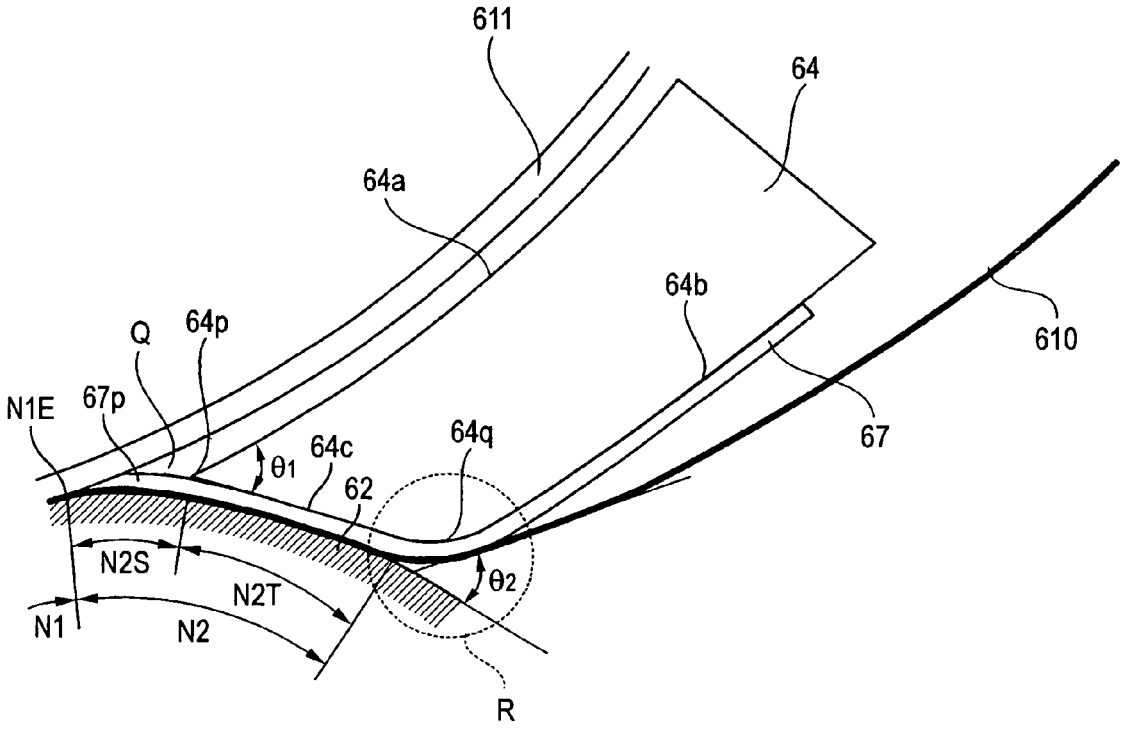
FIG. 14 is a diagram illustrating a structure for supporting both ends of the contact plate.

FIG. 14 is a diagram illustrating a structure for embodying "both-ends support" of the contact plate 67 by bringing the upstream end 67*p* of the contact plate 67 into close contact with the fixing roll 611. As shown in FIG. 14, in this case, the upstream end of the contact plate 67 is formed in a wedge shape to fill a deepest portion of the wedge-shaped region Q. By forming the upstream end 67*p* of the contact plate 67 in the wedge shape, the pressing force from the fixing roll 611 becomes stable and it is difficult to generate wear in the surface of the upstream end 67*p* and the fixing roll 611 although the upstream end 67*p* rubs against the fixing roll 611. Accordingly, it is possible to maintain the function of the contact plate for a long time.

In addition, in order to smoothly perform the circulation of the fixing belt 610 in the stripping pad nip portion N2, it is preferable that a surface of the contact plate 67 contacting the fixing belt 610 is coated with a sheet made of a material having a low frictional coefficient and a high abrasion resistance, for example, Teflon (trade mark).

In addition, in the fixing unit 60 according to the third exemplary embodiment, the contact plate 67 and the stripping pad 64 are individual made, and the contact plate 67 is fixedly supported by the stripping pad 64. However, the contact plate 67 and the stripping pad 64 may be formed integrally.

Like this, in the fixing unit 60 according to the third exemplary embodiment, a nip portion N including a roll nip portion N1 and a stripping pad nip portion N2 is formed in a region where the fixing belt module 61 comes in close contact with the pressurization roll 62. The stripping pad 64 is disposed in the vicinity of the downstream of the roll nip portion N1, and the contact plate 67 is disposed as a member for pressing the fixing belt 610 to the pressurization roll 62 in the boundary region N2S of the roll nip portion N1 in the stripping pad nip portion N2. By doing so, in the nip portion N, occurrence of a valley region where the nip pressure is lowered is suppressed, so that it is possible to form the nip pressure Pn satisfying the aforementioned expression (1) in the boundary region N2S. In addition, by doing so, in a region from a position where the nip pressure has a peak value in the roll nip portion N1 to the most downstream position of the stripping pad nip portion N2 in the nip portion N, the nip pressure can be set to continuously monotonously decrease.

Like this, a predetermined nip pressure Pn is set for the boundary region N2S, it is possible to suppress bubbles from occurring in the boundary region N2S. In addition, by setting the nip pressure to continuously monotonously decrease, it is possible to gradually open the steam or to-be-thermally-expanded air suppressed by the high nip pressure in the roll nip portion N1 in a path until the stripping pad nip portion N2 is passed. By doing so, since a phenomenon that the bubbles generated from the stream or the thermally expanded air are floated in the nip can be prevented, the toner image which is not completely solidified cannot be disturbed, so that it is possible to prevent image defects such as image stains from occurring in the fixing image.

In addition, since the stripping pad 64 constituting the stripping pad nip portion N2 has a shape of a substantially arc, the traveling direction of the fixing belt 610 passing through the stripping pad nip portion N2 rapidly changes to be curved. Therefore, the sheet P passing through the roll nip portion N1 and the stripping pad nip portion N2 are stripped from the fixing belt 610 at the time that the paper exits from the stripping pad nip portion N2, so that it is possible to stably perform curvature stripping of the sheet P.

Here, a sheet stripping performance and an image quality (existence of image deviation) of the fixing unit 60 according to the third exemplary embodiment are evaluated. In the evaluation test, a process speed of the fixing unit 60 is set to 350 mm/s and 440 mm/s, and 10000 sheets are fed for each case. As the sheet P, OK middle grade coated paper (59 gsm paper) manufactured by Oji Paper Co., Ltd. is used. In addition, as the toner image formed on the sheet P, a solid image having a distal end margin width of 3 mm and a toner density of 13 g/m$^2$ is used. The evaluation condition of the test experiment for forming a solid image having a narrow distal end margin width by using such a paper sheet having a small size is employed because the evaluation condition is a strict condition for the stripping of paper.

In addition, as a comparative example, a similar evaluation test is performed by using a conventional fixing unit having a construction where the stripping pad 64 and the contact plate 67 are not provided, that is, a construction where the nip portion N is constructed with only the roll nip portion N1.

The test result is shown in FIG. 15. As shown in FIG. 15, in the fixing unit 60 according to the third exemplary embodiment, a good paper stripping process is performed in both cases of the process speeds of 350 mm/s and 440 mm/s, so that a jam is detected not to occur. On the contrary, in the conventional fixing unit, the stripping failure of the sheet P occurs at the beginning of the running, so that the evaluation test must be stopped at the time of feeding 1000 sheets. Particularly, there is detected a tendency that the occurrence frequency in the case for the process speed of 440 mm/s is higher than that in the case for the process speed of 350 mm/s.

On the other hand, the occurrence of the image deviation is not detected in any one of the fixing unit 60 according to the third exemplary embodiment and the conventional fixing unit. This is because the occurrence of bubbles in the boundary region N2S can be suppressed by setting the nip pressure Pn to a predetermined nip pressure Pn1 or more in the boundary region N2S in the fixing unit 60 according to the third exemplary embodiment as described above. In addition, this is because the nip pressure is set to continuously monotonously decrease in the region from the central portion of the roll nip portion N1 to the stripping pad nip portion N2, so that the steam or to-be-thermally-expanded air suppressed by the high nip pressure in the roll nip portion N1 can be gradually opened in the path until the stripping pad nip portion N2 is passed.

As a result, it is estimated that the occurrence of the image defects such as image stains in the fixing image are suppressed.

On the other hand, it is estimated, this is because, in the conventional fixing unit to which only the roll nip portion N1 is provided, the construction that the nip pressure continuously monotonously decreases in the region from the central portion of the roll nip portion N1 to the nip outlet is not provided.

Now, a fixing operation of the fixing unit 60 according to the third exemplary embodiment will be described.

In the secondary transfer unit 20 (see FIG. 1) of the image forming apparatus, the sheet P on which the non-fixed toner image is electro-statically transferred is fed toward the nip portion N (see FIG. 2, a direction of arrow F) of the fixing unit 60 by the feeding belt 55 and the fixing inlet guide 56. The non-fixed toner image on the surface of the sheet P passing through the nip portion N is fixed on the sheet P by pressure and heat mainly exerted on the roll nip portion N1.

At this time, in the fixing unit 60 according to the third exemplary embodiment, the heat exerted on the nip portion N is mainly supplied by the fixing belt 610. The fixing belt 610 is constructed to be heated by heat supplied through a fixing roll 611 from a halogen heater 616*a* disposed in an inner portion of the fixing roll 611, heat supplied through a tension roll 612 from a halogen heater 616*b* disposed in an inner portion of the tension roll 612, and heat supplied through a tension roll 613 from a halogen heater 616*c* disposed in an inner portion of the tension roll 613. As a result, thermal energy can be suitably and rapidly supplied to the fixing belt 610 form the tension roll 612 and the tension roll 613, so that it is possible to secure a sufficient heat amount in the nip portion N even at a high process speed of 350 mm/s.

Namely, in the fixing unit 60 according to the third exemplary embodiment, the fixing belt 610 serving as a direct heating member can be formed to have a very small heat capacity. In addition, the fixing belt 610 is constructed to contact the heat supplying members, that is, the fixing roll 611, the tension roll 612, and the tension roll 613 with a wide wrapping area (a large wrapping angle). Therefore, since a sufficient heat amount is supplied from the fixing roll 611, the tension roll 612, and the tension roll 613 in a short time of one rotation of the fixing belt 610, it is possible to return the fixing belt 610 to a required fixing temperature in a short time. By doing so, in the nip portion N, although the fixing unit 60 operates at a high speed, it is possible to maintain a predetermined fixing temperature at any time.

As a result, in the fixing unit 60 according to the third exemplary embodiment, it is possible to maintain the fixing temperature at a substantially uniform value even in a continuous feeding case. In addition, it is possible to prevent occurrence of the temperature drooping phenomenon that the fixing temperature drops at the time of initiating the high fixing operation. Particularly, in case of the fixing operation for a thick paper sheet having a large heat capacity, it is possible to maintain the fixing temperature and prevent occurrence of the temperature drooping phenomenon. More-over, in a case where there is a need to change the fixing temperature corresponding to the types of the paper sheets (the case including up and down of the fixing temperature), since the heat capacity of the fixing belt 610 is small, it is possible to easily and rapidly perform changeover to the desired temperature by output adjustment of the halogen heater 616*a*, the halogen heater 616*b*, and the halogen heater 616*c*.

In addition, in the fixing unit 60 according to the third exemplary embodiment, the fixing roll 611 which is the one of the rolls constituting the roll nip portion N1 is a hard roll formed by coating the surface of an aluminum core bar (core roll) with a heat-resistant resin (fluorine resin), and the fixing roll 611 is not coated with an elastic layer. In addition, The pressurization roll 62 which is the other roll constituting the roll nip portion N1 is a soft roll, and the pressurization roll 62 is coated with an elastic layer 622.

For the reason, in the fixing unit 60 according to the third exemplary embodiment, a construction that the fixing roll 611 at the side where the fixing belt 610 is wrapped is not almost deformed can be implemented. By doing so, when passing through the roll nip portion N1, the traveling speed of the fixing belt 610 can be maintained to be uniform, so that it is possible to prevent occurrence of wrinkle or deformation of the fixing belt 610 in the roll nip portion N1. As a result, when the sheet P passes through the roll nip portion N1, the occurrence of the toner image deviation caused by the wrinkle or deformation of the fixing belt 610 can be suppressed, so that it is possible to stably provide a good image quality of the fixing image.

Subsequently, after passing through the roll nip portion N1, the sheet P is fed into the stripping pad nip portion N2. In the stripping pad nip portion N2, the stripping pad 64 is pressed to the pressurization roll 62 through the contact plate 67, and the fixing belt 610 is pressed to the pressurization roll 62. Accordingly, as shown in FIG. 3, the roll nip portion N1 has a downwardly-convex curved shape corresponding to the curvature of the fixing roll 611. On the contrary, the stripping pad nip portion N2 has an upwardly-convex curved shape corresponding to the curvature of the pressurization roll 62.

For the reason, the traveling direction of the sheet P heated and pressed under the curvature of the fixing roll 611 in the roll nip portion N1 changes with a curvature toward a direction opposite to the pressurization roll 62 in the stripping pad nip portion N2. At this time, a small micro slip is generated between the toner image on the sheet P and the surface of the fixing belt 610. Accordingly, the attaching force between the toner image and the fixing belt 610 is weakened, so that the state of the sheet P becomes a state that the sheet P can be easily stripped from the fixing belt 610. Like this, the position determination for the stripping pad nip portion N2 can be also performed by a preparation process for surely performing the stripping in a final stripping process.

In addition, in the exit portion of the stripping pad nip portion N2, the fixing belt 610 is fed to wind the stripping pad 64 on which the contact plate 67 is fixed, so that the feeding direction of the fixing belt 610 rapidly changes at the position. Namely, since the fixing belt 610 moves along the outer surface 64*b* of the stripping pad 64, the curvature of the fixing belt 610 becomes large. Therefore, in the stripping pad nip portion N2, the sheet P, of the attaching force to the fixing belt 610 is weakened in advance, can be surely self-stripped from the fixing belt 610 due to the paper resilience of the sheet P.

Like this, the sheet P is stripped from the fixing belt 610 at the time that the paper sheet exits from the stripping pad nip portion N2, so that it is possible to stably and surely perform the curvature stripping.

Next, the sheet P stripped from the fixing belt 610 is discharged by the sheet discharging guide 65 and the sheet discharging roll 66, so that the fixing process is completed.

As describe above, since the fixing unit 60 according to the third exemplary embodiment employs the fixing belt module 61 where the fixing belt 610 as a heating member is stretched on the plural rolls including the fixing roll 611, it is possible to maintain a predetermined fixing temperature at any time in the fixing unit 60 although the image forming apparatus operates at a high speed. In addition, it is possible to prevent occurrence of the temperature drooping phenomenon that the fixing temperature drops at the time of initiating the high fixing operation. As a result, it is possible to provide a large number of high-quality fixing images in a short time.

In addition, the nip portion N is constructed with the roll nip portion N1 and the stripping pad nip portion N2 which are disposed consecutively to the roll nip portion N1 at the downstream of the roll nip portion N1. In addition, the stripping pad 64 constituting the stripping pad nip portion N2 is disposed in the vicinity of the downstream of the roll nip portion N1, and the contact plate 67 for pressing the fixing belt 610 to the pressurization roll 62 is disposed in the boundary region N2S for the roll nip portion N1 in the stripping pad nip portion N2. By doing so, in the boundary region N2S, the occurrence of a valley region where the nip pressure is lowered is suppressed by setting the nip pressure Pn satisfying the aforementioned expression (1), so that it is possible to prevent the occurrence of bubbles in the boundary region N2S.

In addition, in a region from a position where the nip pressure has a peak value in the roll nip portion N1 to the most downstream position of the stripping pad nip portion N2, the nip pressure can be set to continuously monotonously decrease.

Like this, in the fixing unit 60 according to the third exemplary embodiment, it is possible to prevent the occurrence of bubbles in the boundary region N2S, and by setting the nip pressure to continuously monotonously decrease, it is possible to gradually open the steam or to-be-thermally-expanded air suppressed by the high nip pressure in the roll nip portion N1 in a path until the stripping pad nip portion N2 is passed, so that a phenomenon that the bubbles generated from the stream or the thermally expanded air are floated in the nip can be prevented. Accordingly, the toner image which is not completely solidified cannot be disturbed, so that it is possible to prevent image defects such as image stains from occurring in the fixing image.

In addition, since the stripping pad 64 constituting the stripping pad nip portion N2 has a shape of a substantially arc, the traveling direction of the fixing belt 610 passing through the stripping pad nip portion N2 rapidly changes to be curved. Therefore, the sheet P passing through the roll nip portion N1 and the stripping pad nip portion N2 are stripped from the fixing belt 610 at the time that the paper exits from the stripping pad nip portion N2, so that it is possible to stably perform curvature stripping of the sheet P.

Fourth Exemplary Embodiment

In the first exemplary embodiment, the configuration that the pressurization roll 62 is used as the pressurization member disposed to come in close contact with the fixing belt module 61 in the fixing unit 60 mounted on an image forming apparatus has been described. In a fourth exemplary embodiment, a configuration that a pressurization belt module 70 in which a pressurization belt 700 is stretched on plural rolls is used as the pressurization member will be described. The same elements as the first exemplary embodiment are denoted by the same reference numerals and detailed description thereof is omitted herein.

Figure 16:
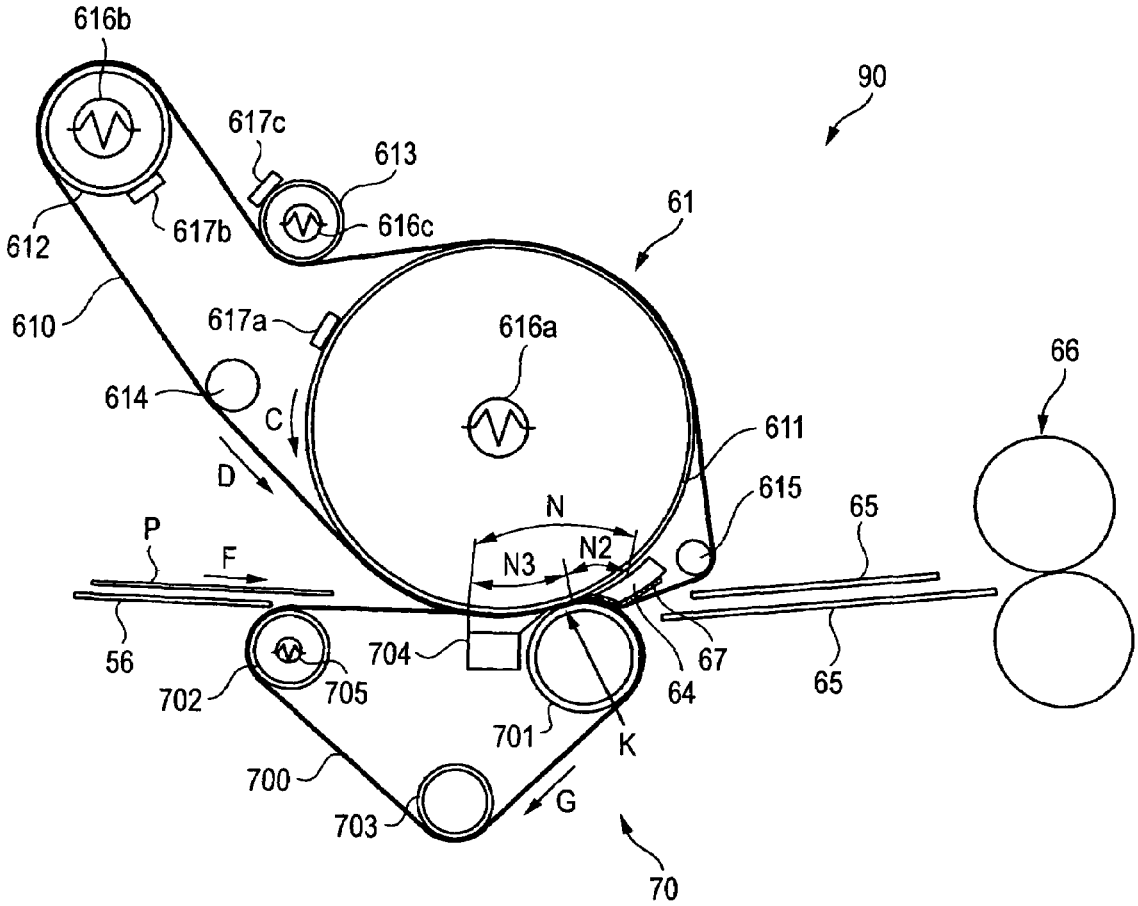
FIG. 16 is a side cross-sectional view schematically illustrating a configuration of a fixing unit according to a fourth exemplary embodiment.

FIG. 16 is a side cross-sectional view illustrating a configuration of a fixing unit 90 according to the fourth exemplary embodiment. The configuration of the fixing unit 90 according to the fourth exemplary embodiment is similar to that of the fixing unit 60 according to the first exemplary embodiment, except that the pressurization belt module 70 instead of the pressurization roll 62 is disposed as the pressurization member.

The pressurization belt module 70 according to the fourth exemplary embodiment includes a pressurization belt 700 stretched by three rolls of a pressurization roll 701, an inlet roll 702, and a tension roll 703 and a pressure pad 704 as a pressing member disposed to be biased to the fixing roll 611 with the pressurization belt 700 and the fixing belt 610 therebetween. The pressurization belt module 70 is disposed to be pressed to the fixing belt module 61 and the pressurization belt 700 circulates in the arrow G direction with the rotation of the fixing roll 611 as the fixing roll 611 of the fixing belt module 61 rotates in the arrow C direction. The traveling speed thereof is 300 mm/s, which is equal to the surface speed of the fixing roll 610.

In the nip portion N in which the pressurization belt module 70 and the fixing belt module 61 come in close contact with each other, a belt nip portion N3 in which the pressurization belt 700 comes in close contact with the outer circumferential surface of the fixing belt 610 is defined.

In the fixing unit 90 according to the fourth exemplary embodiment, the pressure pad 704 is disposed in the pressurization belt 700 to be biased to the fixing roll 611 with the pressurization belt 700 therebetween and thus presses the pressurization belt 700 to the wrap region of the fixing roll 611. At the most downstream portion of the belt nip portion N3, the pressurization roll 701 is biased to the central axis of the fixing roll 611 with the pressurization belt 700 and the fixing belt 610 therebetween by the use of a compression coil spring (not shown) as a bias member to generate a local high pressure in the contact portion between the fixing roll 611 and the fixing belt 610.

Accordingly, since the belt nip portion N3 can be formed wide, it is possible to embody a more stable fixing performance of the toner image on the sheet P. Since a pressure can be efficiently given to the fused toner image by the use of the local high pressure from the pressurization roll 701, a high fixing property can be obtained and the surface of the toner image can be smoothed, thereby giving excellent image gloss to color images.

Here, the pressurization belt 700 disposed in the pressurization belt module 70 includes a base layer made of resin having an excellent heat resistance such as polyimide, polyamide, and polyamideimide. The thickness of the base layer is in the range of, for example, 50 to 125 μm. The pressurization belt 700 can be a configuration that one surface of the base layer facing the fixing roll 611 or both surfaces thereof are coated with the detachment layer. In this case, fluorine resin such as PFA may be formed with a thickness of 5 to 20 μm as the detachment layer. Furthermore, the pressurization belt may have a stacked structure that an elastic layer is formed between the base layer and the detachment layer as needed. In this case, silicon rubber with a thickness of 100 to 200 μm can be used as the elastic layer. In the fixing unit 60 according to the second exemplary embodiment, the pressurization belt 700 includes only the base layer made of a polyimide film with a thickness of 75 μm, a width of 350 mm, and a circumferential length of 240 mm.

The three rolls stretching the pressurization belt 700 include the pressurization roll 701 in which a steel core is coated with silicon rubber as an elastic layer, the inlet roll 702 made of stainless steel, and the tension roll 703 made of stainless steel. The outer diameter of the pressurization roll 701 is 25 mm, the outer diameter of the inlet roll 702 is 22 mm, and the tension roll 703 is 20 mm. The length of the rolls is 360 mm. A halogen heater 705 as a heating source is disposed in the inlet roll 702. The surface temperature thereof is controlled to 120° C. by a temperature sensor not shown and the control unit 40 (see FIG. 1) and the pressurization belt 700 is pre-heated.

The pressurization roll 701 is biased to the central axis of the fixing roll 611 through the pressurization belt 700 and the fixing belt 610 by the use of a compression coil spring (not shown) as a pressurization unit to generate a local high pressure in the contact portion between the fixing roll 611 and the fixing belt 610. In this case, in order to efficiently apply the local high pressure of the fixing roll 611 and the fixing belt 610, the pressurization roll 701 has a diameter smaller than that of the fixing roll 611.

A belt edge position detecting mechanism for detecting the belt edge position of the pressurization belt 700 and an axial displacement mechanism for displacing the contact position in the axial direction of the pressurization belt 700 in accordance with the detection result of the belt edge position detecting mechanism may be disposed in one roll of the pressurization roll 701, the inlet roll 702, and the tension roll 703, thereby controlling the meandering (belt walk) of the pressurization belt 700.

The pressure pad 704 as the pressing member includes an elastic member for securing a wide belt nip portion N3 and a low-friction layer disposed on the surface of the elastic member contacting the inner circumferential surface of the pressurization belt 700 and is held in a holder (not shown) made of metal. In the elastic member having the low-friction layer thereon, the surface facing the fixing roll 611 is formed in a concave shape corresponding to the outer circumferential surface of the fixing roll 610 and is disposed to press the fixing roll 611 to form an entrance region of the belt nip portion N3 formed in the wrap region of the fixing roll 611.

An elastic material such as silicon rubber and fluorine rubber having an excellent heat resistance can be used as the elastic member of the pressure pad 704. The low-friction layer formed on the elastic member serves to reduce the sliding resistance between the inner circumferential surface of the pressurization belt 700 and the pressure pad 704 and is preferably made of a material having a small friction coefficient and a wear resistance. Specifically, a glass fiber sheet, a fluorine resin sheet, and a fluorine resin film impregnated with Tefron (registered trademark) may be used.

In the fixing unit 90 according to the fourth exemplary embodiment, a stripping pad 64 is disposed in the vicinity of the downstream side from the belt nip portion N3. The stripping pad nip portion N2 in which the fixing belt 610 is wound around the surface of the pressurization roll 62 is formed successive to the roll nip portion N1. In addition, in the boundary region with the belt nip portion N3 in the stripping pad nip portion N2, the contact plate 67 is disposed as a member pressing the fixing belt 610 onto the pressurization roll 701.

In addition, in the stripping pad nip portion N2 defined by the stripping pad 64 and the contact plate 67, similarly to the fixing unit 60 according to the first exemplary embodiment, the nip pressure Pn in the boundary region to the belt nip portion N3 in the stripping pad nip portion N2 is set to a predetermined value (see Expression (1)). Accordingly, a valley region in which the nip pressure decreases can be presented from occurring, thereby preventing the occurrence of bubbles in the region. In addition, the nip pressure is set to monotonously and continuously decrease in the region from the position where the nip pressure peaks in the belt nip portion N3 to the most downstream position of the stripping pad nip portion N2. Therefore, the steam suppressed by the high nip pressure in the belt nip portion N3 or the air to be thermally expanded can be gradually opened in the path until the sheet passes through the stripping pad nip portion N2, thereby preventing the occurrence of a phenomenon that the steam or the thermally expanded air strays as bubbles in the nip portion. Accordingly, the toner image which is not solidified completely is hardly disturbed, thereby preventing the occurrence of image defects such as image stains in the fixed image.

In addition, since the stripping pad 64 defining the stripping pad nip portion N2 has a circular arc-shaped section, the traveling direction of the fixing belt 610 passing through the stripping pad nip portion N2 varies abruptly. Accordingly, the sheet P having passed through the belt nip portion N1 and the stripping pad nip portion N2 can be stripped from the fixing belt 610 at the time when the sheet exits from the stripping pad nip portion N2, thereby stably performing the curvature stripping of the sheet P.

As other examples of the exemplary embodiments, the invention may be applied to an image forming apparatus such as a copier and a printer employing an electrophotographic manner and may be applied to a fixing unit for fixing a non-fixed toner image carried on a recording sheet (sheet of paper). In addition, the invention may be applied to an image forming apparatus such as a copier and a printer employing an inkjet manner and may be applied to a fixing unit for drying a non-dried ink image carried on a recording sheet (sheet of paper).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing unit for fixing a toner image on a recording material, the fixing unit comprising:

a rotatable fixing roll;

a fixing belt stretched on the fixing roll;

at least one tension roll for stretching the fixing belt together with the fixing roll;

a pressurization member disposed to give a pressure to the fixing roll; and a stripping member disposed to press an outer surface of the fixing belt onto the pressurization member in a vicinity of a downstream side of a contact portion between the fixing roll and the pressurization member, wherein the pressurization member has a larger recess amount in the first contact portion than a recess amount of the fixing roll in the first contact portion.

2. The fixing unit according to claim 1, wherein the stripping member is formed of a block member having a circular arc-shaped section.

3. The fixing unit according to claim 1, wherein the stripping member comprises a pressing surface having a predetermined width in a traveling direction of the fixing belt, and wherein the pressing surface of the stripping member presses the pressurization member.

4. The fixing unit according to claim 3, wherein the pressing surface of the stripping member presses the pressurization member with an average pressure of 7 $N/cm^2$ or more.

5. The fixing unit according to claim 3, wherein the stripping member is disposed so that an upstream end of the pressing surface in the traveling direction of the fixing belt is apart by 0.7 mm or less from the fixing roll.

6. The fixing unit according to claim 3, wherein the stripping member is disposed so that an upstream end of the pressing surface in the traveling direction of the fixing belt comes in contact with the fixing roll.

7. The fixing unit according to claim 3, wherein the pressing surface of the stripping member is formed in a plane or a curved surface corresponding to a surface shape of the pressurization member.

8. The fixing unit according to claim 1, wherein a side surface of the stripping member facing the fixing roll is substantially formed in a circular arc shape corresponding to a surface shape of the fixing roll.

9. The fixing unit according to claim 1, wherein a side surface of the stripping member disposed opposite to the fixing roll is formed in such a shape to abruptly vary the traveling direction of the fixing belt.

10. The fixing unit according to claim 1, wherein the at least one tension roll has a heating source.

11. A fixing unit comprising:

a rotatable fixing roll;

a belt member which is wound around the fixing roll and which rotates with the rotation of the fixing roll;

a pressurization member disposed to give a pressure to the fixing roll through the belt member and to form a first nip portion;

a pressing member disposed between the fixing roll and the belt member in a vicinity of a downstream side in a traveling direction of the belt member from the first nip portion to press the pressurization member through the belt member and to form a second nip portion, wherein the belt member and the pressurization member come in contact with each other at the first nip portion and the second nip portion, and wherein the pressurization member has a larger recess amount in the first contact portion than a recess amount of the fixing roll in the first contact portion.

12. The fixing unit according to claim 11, wherein a nip pressure of the second nip portion monotonously decreases in the traveling direction of the belt member.

13. The fixing unit according to claim 11, wherein the second nip portion is formed continuously in the traveling direction of the belt member in the vicinity of the downstream side from the first nip portion.

14. The fixing unit according to claim 11, wherein the first nip portion and the second nip portion have a curved direction opposite to each other.

15. The fixing unit according to claim 11, wherein the pressurization member has a larger recess amount in the first nip portion than a recess amount in the second nip portion.

16. The fixing unit according to claim 11, further comprising:

a stripping member pressing the belt member onto the pressurization member in the second nip portion.

17. The fixing unit according to claim 16, wherein an upstream end of a surface of the stripping member pressing the pressurization member with the belt is disposed in a wedge-shaped region defined by the fixing roll and the pressurization member.

18. The fixing unit according to claim 11, wherein the pressurization member is a roll member in which an elastic layer is formed on a surface of the roll member.

19. The fixing unit according to claim 10, wherein a heating member is disposed in the fixing roll and a heating member is disposed in the tension roll.

20. An image forming apparatus comprising:

a toner image forming unit forming a toner image;

a transfer unit transferring the toner image formed by the toner image forming unit onto a recording material; and a fixing unit fixing the toner image transferred onto the recording material to the recording material, the fixing unit comprising:

a fixing belt module comprising a rotatable fixing roll and a fixing belt stretched on the fixing roll and a tension roll;

a pressurization member disposed to give a pressure to the fixing roll; and a stripping member disposed to press an outer surface of the fixing belt onto the pressurization member in a vicinity of a downstream side of a contact portion between the fixing roll and the pressurization member, and wherein the fixing belt module and the pressurization member come in contact with each other at a first nip portion and a second nip portion, wherein the first nip portion is formed by the fixing roll and the pressurization member with the fixing belt therebetween, wherein the second nip portion is formed by the pressurization member and the stripping member with the fixing belt therebetween, and wherein the pressurization member has a larger recess amount in the first contact portion than a recess amount of the fixing roll in the first contact portion.

21. The image forming apparatus according to claim 20, wherein a nip pressure in the second nip portion of the fixing unit is set to monotonously decrease in a traveling direction of the fixing belt.

22. The image forming apparatus according to claim 20, wherein the pressurization member of the fixing unit is formed of a roll member.

23. The image forming apparatus according to claim 20, wherein the pressurization member of the fixing unit is formed of a pressurization belt module in which a belt member is stretched on a plurality of tension rolls.

24. The image forming apparatus according to claim 23, wherein the pressurization belt module has a non-rotatable pressing member for pressing the fixing roll with the fixing belt therebetween.

25. The fixing unit according to claim 1, further comprising:

a contact member for bringing an outer surface of the fixing belt into close contact with the pressurization member in an intermediate region between a first contact portion between the fixing roll and the pressurization member and a second contact portion between the pressurization member and the stripping member.

26. The fixing unit according to claim 25, wherein the contact member is formed of a plate-shaped member having a spring elasticity.

27. The fixing unit according to claim 25, wherein the stripping member is formed of a block member having a circular arc-shaped section.

28. The fixing unit according to claim 25, wherein a side surface of the stripping member facing the fixing roll is formed in a circular shape corresponding to a surface shape of the fixing roll.

29. The fixing unit according to claim 25, wherein the stripping member comprises:

a pressing surface facing the pressurization member, the pressing surface having a predetermined width in the traveling direction of the belt member; and a stripping surface facing a fixing roll, the stripping surface having such a shape that the traveling direction of the belt member is varied to be bent.

30. The fixing unit according to claim 29, wherein the pressing surface of the stripping member is formed in a plane or a curved surface corresponding to the surface shape of the pressurization member.

31. The fixing unit according to claim 29, wherein the contact member is pressed to the pressurization member by the pressing surface of the stripping member.

32. The fixing unit according to claim 29, wherein the pressing member is fixed to and supported by the stripping surface of the stripping member.

33. The fixing unit according to claim 25, wherein an upstream end of the contact member in a traveling direction of the belt member is a free end.

34. The fixing unit according to claim 25, wherein the upstream end of the contact member in a traveling direction of the belt member is disposed to come in contact with the fixing roll.

35. A fixing unit for fixing a toner image supported on a recording material, comprising:

a rotatable fixing roll;

a belt member stretched on the fixing roll;

a tension roll for stretching the belt member;

a pressurization member disposed to give a pressure to the fixing roll; and a stripping member disposed to press an outer surface of the belt member onto the pressurization member in a vicinity of a downstream side of a contact portion between the fixing roll and the pressurization member, wherein a nip pressure Pn in an intermediate region between a first contact portion between the fixing roll and the pressurization member and a second contact portion between the pressurization member and the stripping member is set greater than or equal to a predetermined pressure value.

36. The fixing unit according to claim 35, wherein the nip pressure Pn of the intermediate region satisfies a following expression:

$$Pn \geqq Pox(Tn/To-1),$$

where

Tn denotes an absolute temperature of the belt member,

To denotes an absolute temperature of a peripheral environment, and

Po denotes an atmospheric pressure.

37. The fixing unit according to claim 35, wherein a nip pressure in a region from the most downstream portion of the first contact portion to the most downstream portion of the second contact portion monotonously decreases in a traveling direction of the belt member.

38. The fixing unit according to claim 35, wherein the pressurization member has a larger recess amount in the first contact portion than a recess amount of the fixing roll in the first contact portion.

39. The fixing unit according to claim 35, further comprising:

a contact member bringing the belt member into close contact with the pressurization member in the intermediate region.

40. The fixing unit according to claim 39, wherein the contact member is formed integrally with the stripping member.

41. The fixing unit according to claim 39, wherein an upstream end of the contact member in a traveling direction of the belt member is disposed in a wedge-shaped region defined by the fixing roll and the pressurization member.

42. The fixing unit according to claim 35, wherein the pressurization member is a roll member in which an elastic layer is formed on a surface of the roll member.

43. The fixing unit according to claim 35, wherein a heating member is disposed in the fixing roll, and wherein the heating member is disposed in the tension roll.

44. An image forming apparatus comprising:

a toner image forming unit forming a toner image;

a transfer unit transferring the toner image formed by the toner image forming unit onto a recording material; and a fixing unit fixing the toner image transferred onto the recording material to the recording material, the fixing unit comprising;

a rotatable fixing roll;

a belt member stretched on the fixing roll;

a tension roll stretching the belt member;

a pressurization member disposed to give a pressure to the fixing roll;

a stripping member disposed to press an outer surface of the belt member onto the pressurization member in a vicinity of a downstream side from a contact portion between the fixing roll and the pressurization member; and a contact member disposed to bring an outer surface of the belt member into close contact with the pressurization member in an intermediate region between a first contact portion between the fixing roll and the pressurization member and a second contact portion between the pressurization member and the stripping member, and wherein a nip pressure Pn in the intermediate region is set greater than or equal to a predetermined pressure value.

45. The image forming apparatus according to claim 44, wherein the nip pressure Pn of the intermediate region satisfies a following expression:

$$Pn \geqq Pox(Tn/To-1),$$

where

Tn denotes an absolute temperature of the belt member,

To denotes an absolute temperature of a peripheral environment, and

Po denotes an atmospheric pressure.

46. The image forming apparatus according to claim 44, wherein a nip pressure in a region from the most downstream portion of the first contact portion to the most downstream portion of the second contact portion monotonously decreases in a traveling direction of the belt member.

47. The image forming apparatus according to claim 44, wherein the pressurization member of the fixing unit is formed of a roll member.

48. The image forming apparatus according to claim 44, wherein the pressurization member of the fixing unit is formed of a pressurization belt module in which a belt member is stretched on a plurality of tension rolls.

* * * * *